US010822889B2

(12) United States Patent
Daigle et al.

(10) Patent No.: US 10,822,889 B2
(45) Date of Patent: Nov. 3, 2020

(54) LOAD TRANSFER SYSTEM FOR STANDS OF TUBULARS

(71) Applicant: Frank's International, LLC, Houston, TX (US)

(72) Inventors: Jarret Daigle, Lafayette, LA (US); Logan Smith, Lafayette, LA (US); John Erick Stelly, Breaux Bridge, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 16/398,407

(22) Filed: Apr. 30, 2019

(65) Prior Publication Data

US 2019/0352977 A1 Nov. 21, 2019

Related U.S. Application Data

(60) Provisional application No. 62/672,310, filed on May 16, 2018.

(51) Int. Cl.
*E21B 19/02* (2006.01)
*E21B 19/06* (2006.01)
*B66C 1/44* (2006.01)

(52) U.S. Cl.
CPC ..... *E21B 19/02* (2013.01); *B66C 1/44* (2013.01); *E21B 19/06* (2013.01)

(58) Field of Classification Search
CPC ..... E21B 19/02; E21B 19/06; B66C 1/44
See application file for complete search history.

(56) References Cited

U.S. PATENT DOCUMENTS 1,547,282 A * 7/1925 Youker ..... E21B 19/06 294/90
RE29,995 E * 5/1979 Guier ..... E21B 19/06 294/90
5,083,356 A * 1/1992 Gonzalez ..... E21B 19/00 29/429

(Continued)

FOREIGN PATENT DOCUMENTS

WO 2012151148 A2 11/2012

OTHER PUBLICATIONS

Extended European Search Report dated Sep. 16, 2019, EP Application No. 19173661, pp. 1-10.

*Primary Examiner* — Nicole Coy
(74) *Attorney, Agent, or Firm* — MH2 Technology Law Group LLP

(57) ABSTRACT

A load transfer system includes a load transfer bushing having a first and second arcuate segments configured to engage a load surface of a tubular or of a collar connected to the tubular, and an elevator configured to receive the load transfer bushing. Moving the elevator from its closed position to its open position while the elevator engages the load transfer bushing moves the first and second arcuate segments apart, permitting the elevator and the load transfer bushing to be received around the tubular. Moving the elevator from the opened position to the closed position with the load transfer bushing and elevator surrounding the tubular forms an axial engagement load surface for the load surface of the tubular or the collar. The load transfer bushing is disengageable from the elevator.

23 Claims, 21 Drawing Sheets

(56) References Cited

U.S. PATENT DOCUMENTS

| | | | | |
|---|---|---|---|---|
| 6,237,684 | B1 * | 5/2001 | Bouligny, Jr. | E21B 19/10 166/75.14 |
| 6,651,737 | B2 * | 11/2003 | Bouligny | E21B 19/00 166/52 |
| 7,370,707 | B2 * | 5/2008 | McDaniel | E21B 19/004 166/380 |
| 9,206,655 | B2 * | 12/2015 | Sipos | E21B 19/06 |
| 9,341,036 | B2 * | 5/2016 | Sipos | E21B 19/06 |
| 9,630,811 | B2 | 4/2017 | Smith et al. | |
| 9,784,050 | B2 * | 10/2017 | Smith | B66C 1/44 |
| 2015/0233195 | A1 | 8/2015 | Smith et al. | |
| 2015/0259991 | A1 | 9/2015 | Sipos | |
| 2015/0361737 | A1 | 12/2015 | Foley | |

* cited by examiner

LOAD TRANSFER SYSTEM FOR STANDS OF TUBULARS

CROSS-REFERENCE TO RELATED APPLICATION

This application claims priority to U.S. provisional patent application No. 62/672,310, filed May 16, 2018, the contents of which are hereby incorporated by reference.

BACKGROUND

In oilfield operations, tubulars such as casing and completion tubing are run into a wellbore. Load transfer sleeves are sometimes employed to provide an interface between certain tubular handling equipment, specifically an elevator and a rig floor support structure, and the tubulars. Such load transfer sleeves can be designed to be received around a tubular and bear against an axial load support surface along the tubular. Axial load support surfaces are generally provided by a collar, a lift nubbin, or an increased diameter area where the box-end connection is formed. In other cases, the load transfer sleeve may include slips that, when set, form an axial support shoulder to support the load of the tubulars. The tubular may be hoisted from a horizontal orientation to a vertical orientation or simply lifted and moved from one location to another with the tubular being in a vertical orientation e.g., via a spreader bar or an elevator coupled with the load transfer sleeve.

Tubular hoisting equipment generally fall within one of two broad categories. The first category of tubular hoisting equipment is referred to as slip-type handling tools. Slip type handling tools support tubulars and/or tubular strings via high radial gripping forces being applied along a length of the tubular. The surface of the slip that is in contact with the tubular and thru which the radial gripping force is applied is generally fitted with toothed gripping inserts or the contact surface itself has been manufactured so as to have a frictional engagement profile. The high radial force applied to the exterior surface of the slip thru the frictional surface of the slip on to the tubular being gripped is what provides the axial gripping capability of the slip type tubular handling tool. Although slip-type tubular handling tools are suitable and convenient in a variety of applications, in others, radial slip-type tubular handling tools need to be avoided. For example, because the radial gripping force applied by the slips is proportional to the weight of the tubular being supported, very heavy tubular strings supported by slip-type tubular handling tools may be crushed or damaged by the inward gripping force. Furthermore, slips may tend to mark the outside of the tubulars as they bite into the surface, to grip the tubulars. When handling corrosion-resistant tubulars, marking the exterior of the tubulars may not be acceptable. Accordingly, the second category of tubular handling tools are used to overcome some of the limitations of slip type tubular handling tools. The second category of tools can be broadly described as shoulder type tubular handling tools. Shoulder type tubular handling tools provide axial support to tubular strings via direct axial support at an axially oriented shoulder interface between the tubular and the handling tool. Among the handling tools which fall into this category are square shoulder "Side Door" type elevators and "Center Latch" type elevators. Within this category is the various types of "Collar Load Support" type systems (CLS) which rely on the use of bushing type "Load Transfer Sleeves" (LTS) as an interface element between the tubular being supported and an elevator which in turn supports the LTS.

U.S. Pat. Nos. 5,083,356 and 6,237,684 illustrate an example of such CLS systems.

Typically, the bushing-style load transfer sleeves are received around and attached to the upper end of the tubular when the tubular is in a nearly horizontal orientation, near the rig floor. An elevator or some other lifting device then engages the load transfer sleeve, and hoists the tubular upright, and pipe handling equipment is used to present the tubular to well center. The tubular is then made-up to an uppermost box-end connection of the previously-run tubular string, which is supported at the rig floor (typically by another LTS and support structure). Once the connection is fully made, the elevator lifts the string and the LTS at the rig floor and associated support structure release the tubular string, and the weight is carried by the elevator via the interface with the load transfer sleeve. The tubular string is then lowered and set down on a rig floor mounted support structure such as a spear, and the process repeats.

In certain situations, it is desirable to make up to the tubular string, multiple joints of previously made up tubulars known as "stands." as this reduces the number of connections that are required to be made up in order to assemble a string of tubulars. When running stands of tubulars the pre-made up stands of tubulars are "racked back" within the derrick structure of the rig. Racking back stands of tubulars includes placing the stands up in a vertical orientation within a stand support structure of the derrick. In order to make the stands up into a string the stands are then moved to a position that is concentric with the wellbore via a rig pipe racking system. The rig pipe racking system lifts the stand vertically and transports it laterally to a position where the lower end of the stand is concentric with the wellbore and vertically above the upper end of any tubulars suspended within the wellbore. Once the stand has been made up into the string the pipe handling system is required to engage the upper end of the stand that is now made up in to the string and is now protruding up from the string that is suspended in the rotary.

With this type of design, the Load Transfer Sleeve and associated elevator must be connected to the top stand of tubulars rather than at the rig floor level. Stands of tubulars can reach 120 feet (approx. 37 meters) or more, and thus, when stored in a vertical orientation, as described above, prior art transfer sleeves are difficult or impossible to attach to the top of the stand. As a consequence, in some applications, the desire to use LTS Type handling systems as a means of handling tubular strings can result in the single-joint CLS method of lifting and delivering tubulars to well center rather than any stand type handling systems for running tubulars, which slows the running process. An optional design for a remotely operable Load Transfer Sleeve that can be actuated to close around the upper end of a tubular stand is described in U.S. Pat. No. 9,630,811. The design of the LTS described in this patent includes powered actuators such as hydraulic cylinders to function the LTS from the open position to the closed position and vice versa. The actuators require connection to an external power source in the form of hydraulic or pneumatic hoses and/or electrical umbilicals along with other control components on the LTS. It is desirable to provide an LTS type device that does not require a connection to an external power source such as are described above and is a simple device that is free of external control components as well.

What is needed is a bushing-style load transfer system (referenced herein as an "LTB System") that is able to be connected to a stand of tubulars via remote control near the top of the stand, while the stand is in a vertical orientation without requiring hydraulic, pneumatic or electrical hoses/umbilicals.

SUMMARY

Embodiments of the disclosure may provide a load transfer system for oilfield tubulars. The system includes a load transfer bushing having a first arcuate segment and a second arcuate segment, the first and second arcuate segments being configured to engage a load surface of a tubular or of a collar connected to the tubular, an elevator suspended from a rig and configured to receive the load transfer bushing so as to support the tubular via engagement with the load transfer bushing, the elevator having an open position and a closed position. Moving the elevator from the closed position to the open position while the elevator engages the load transfer bushing moves the first and second arcuate segments apart, so as to permit the elevator and the load transfer bushing to be received around the tubular. Moving the elevator from the opened position to the closed position with the load transfer bushing around the tubular forms an axial engagement load surface for engagement with the load carrying surface of the tubular or the collar. The load transfer bushing is disengageable from the elevator while the elevator.

Embodiments of the disclosure may also provide a method for running tubulars including receiving a load transfer bushing into an elevator, opening the elevator, with opening the elevator causing two segments of the load transfer bushing to separate apart, receiving the elevator and the load transfer bushing around a tubular while the elevator is open, closing the elevator, with closing the elevator causing the two segments of the load transfer bushing to at least partially surround and form an axial engagement load surface for the tubular or a collar secured to the tubular, raising the tubular by lifting the elevator, with the elevator supporting a weight of the tubular by engagement with the load transfer bushing, lowering the tubular through a spear by lowering the elevator, until the load transfer bushing engages the spear, continuing to lower the elevator with respect to the spear after engaging the load transfer bushing with the spear, such that the spear disengages the load transfer bushing from the elevator, the spear supporting the weight of the tubular through engagement with the load transfer bushing after disengaging the load transfer bushing from the elevator, again opening the elevator after the spear disengages the load transfer bushing from the elevator, with the load transfer bushing remaining engaged with the tubular when the elevator is again opened, and removing the elevator from around the spear, the tubular, and the load transfer bushing.

Embodiments of the disclosure may also provide a load transfer system including a spear coupled to a rig floor and positioned over a well center, an elevator suspended from the rig and configured to be raised and lowered with respect to the spear, and a load transfer bushing configured to axially engage a load surface of a tubular or of a collar coupled to the tubular. The load transfer bushing is receivable into the elevator such that opening the elevator causes the load transfer bushing to open, so as to receive the load transfer bushing and the elevator around the tubular. The load transfer bushing is disengageable from the elevator.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
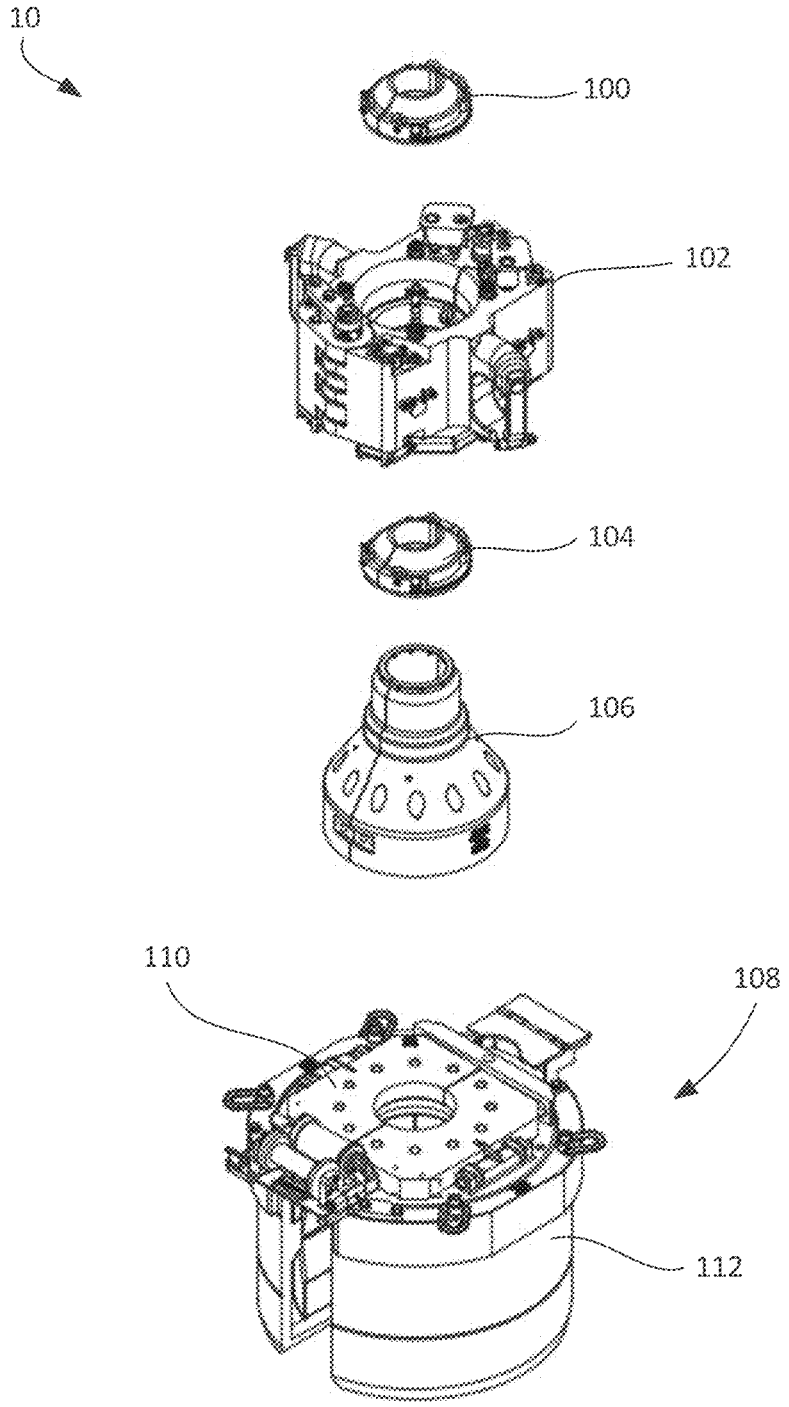
FIG. 1 illustrates an exploded view of a load transfer system, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A. B, or both A and B."

FIG. 1 illustrates an exploded view of a load transfer system 10, according to an embodiment. The load transfer system 10 may be configured to enable engagement, lifting, and controlled lowering of tubulars into a wellbore, e.g., via engagement with an upset (or another generally axially-facing load transfer surface) on the tubular, or of a collar coupled thereto. The load transfer system 10 may generally include a first load transfer bushing 100, a collar load support (CLS) elevator 102, a second load transfer bushing 104, a CLS spear 106, and a support structure assembly 108. The support structure assembly 108 may include top plates 110 and a flush mount shock table 112; however, the support structure assembly 108 shown is merely one example among many contemplated, and other support structure types could be employed. Further, the spear 106 may be opened by movement of the top plates 110, as will be described in greater detail below.

The first and second load transfer bushings 100, 104 may be generally the same in structure and function. Accordingly, for purposes of describing the structure of the load transfer bushings 100, 104, reference is made to the first load transfer bushing 100 only, with it being appreciated that the second load transfer bushing 104 may be generally the same.

Figure 2:
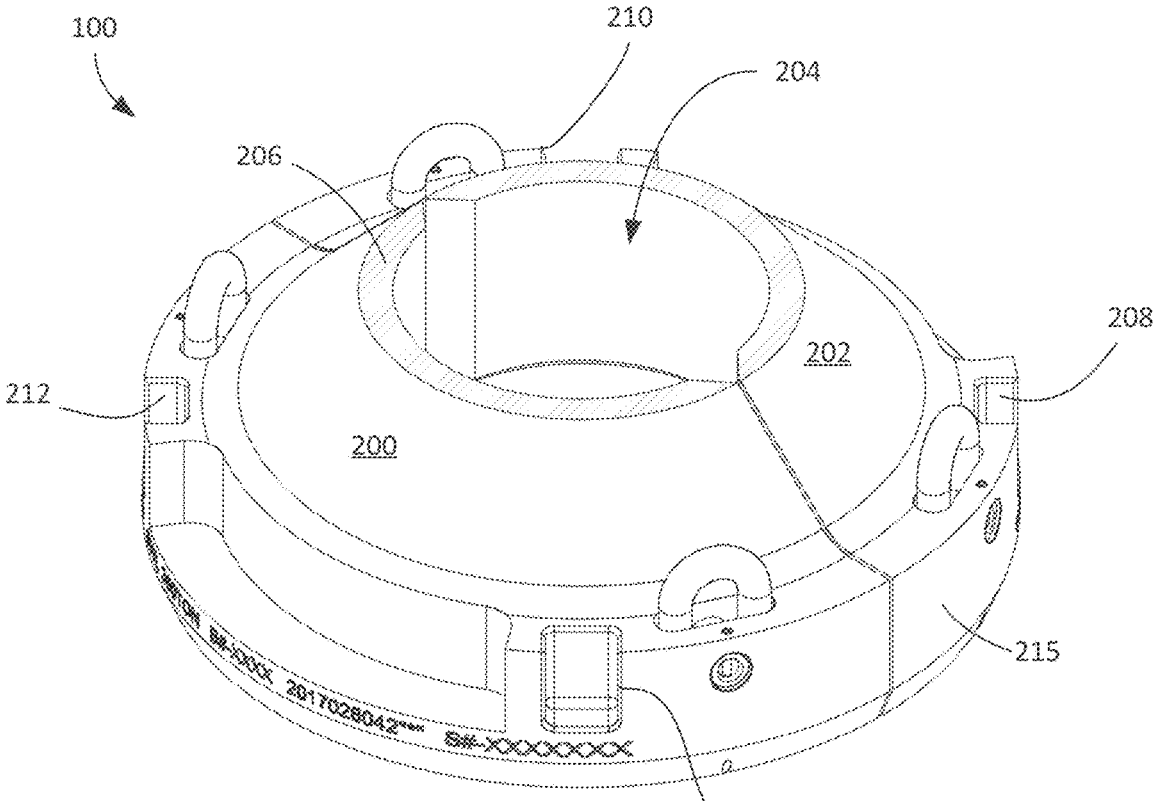
FIG. 2 illustrates a perspective view of a top of a load transfer bushing, according to an embodiment.

FIG. 2 illustrates a perspective view of a top of the load transfer bushing 100, according to an embodiment. The load transfer bushing 100 may include a first arcuate segment 200 and a second arcuate segment 202. In some embodiments, additional segments may also be provided. In this case, however, the first and second segments 200, 202 are generally semi-circular and define a through-bore 204 therein. The through-bore 204 may be sized to be received around a tubular that is supported by the load transfer system 10 (FIG. 1). The first and second segments 200, 202 may cooperatively define an upwardly-facing upset contact surface 206 around the through-bore 204. The upset contact surface 206 may be configured to axially engage an upset formed on or on a coupling connected to a tubular, to support the weight of the tubular.

The first and second segments 200, 202 may not be connected together, but may be free to slide, move apart, or otherwise be displaced one relative to the other. In other embodiments, the segments 200, 202 may be movably connected together, e.g., via hinges, pins, detachable fasteners, etc. Further, the first and second segments 200, 202 may define plate-receiving slots (four shown: 208, 210, 212, 214) around an axially-extending periphery 215 thereof. In the illustrated example, two of the slots 208-214 are provided for each of the segments 200, 202, but it will be appreciated that any number of slots could be used.

Figure 3:
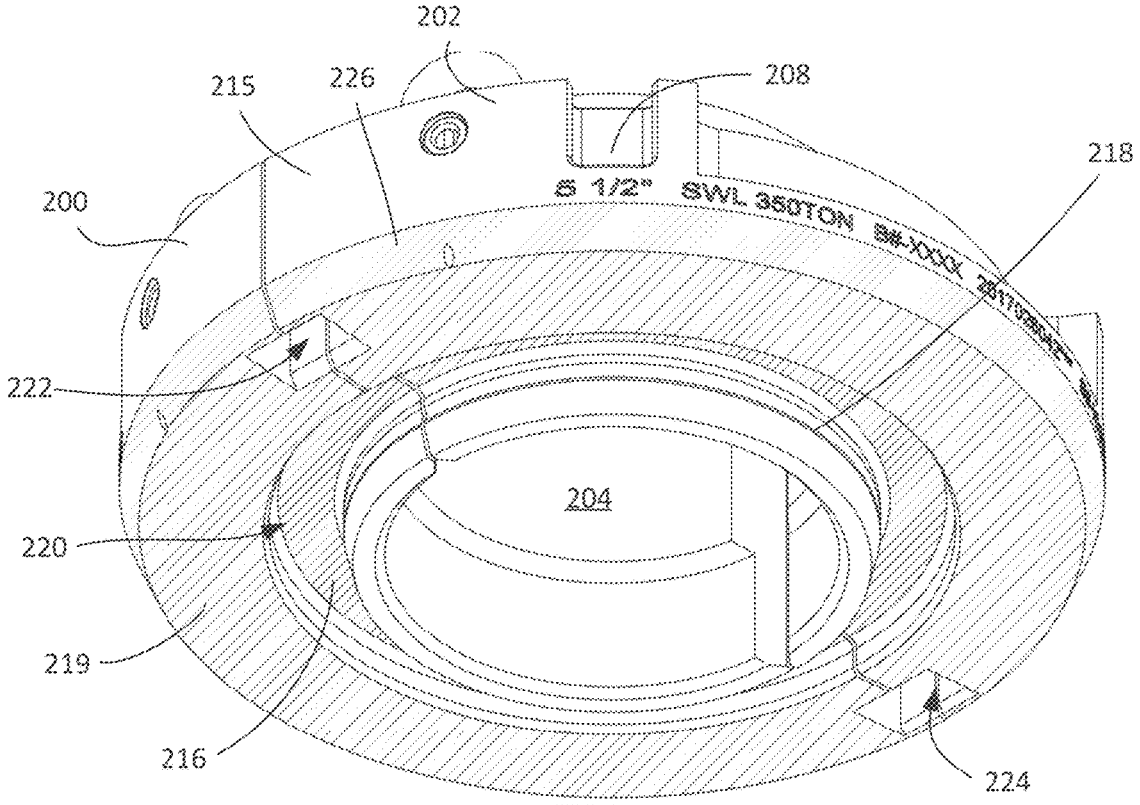
FIG. 3 illustrates a perspective view of a bottom of the load transfer bushing, according to an embodiment.

FIG. 3 illustrates a perspective view of a bottom of the load transfer bushing 100, according to an embodiment. On the bottom, the first and second segments 200, 202 may cooperatively define a spear contact surface 216, a cylindrical inner contour 218 that extends downward, and a bottom surface 219 that extends radially outward from the spear contact surface 216. In particular, the spear contact surface 216 may be defined in an annular groove 220, which is recessed into the bottom surface 219, and thus defined radially between the inner contour 218 and the bottom surface 219. In use, as will be described in greater detail below, the upper end of the spear 106 may be received into the annular groove 220, such that the inner contour 218 is received into the spear 106 (e.g., FIG. 1). As a consequence, the load transfer bushing 100 is held in place on the spear, and the weight of the tubular is transmitted to the spear 106 via contact with the spear contact surface 216.

The first and second segments 200, 202 may also each include two slots 222, 224 on either circumferential end thereof, which will be described in greater detail below. Further, the first and second segments 200, 202 may include a beveled or otherwise angled or profiled locking plate guide surface 226. The locking plate guide surface 226 may provide a transition between the axially-facing, radially-extending bottom surface 219 and the axially-extending, radially facing periphery 215.

Figure 4:
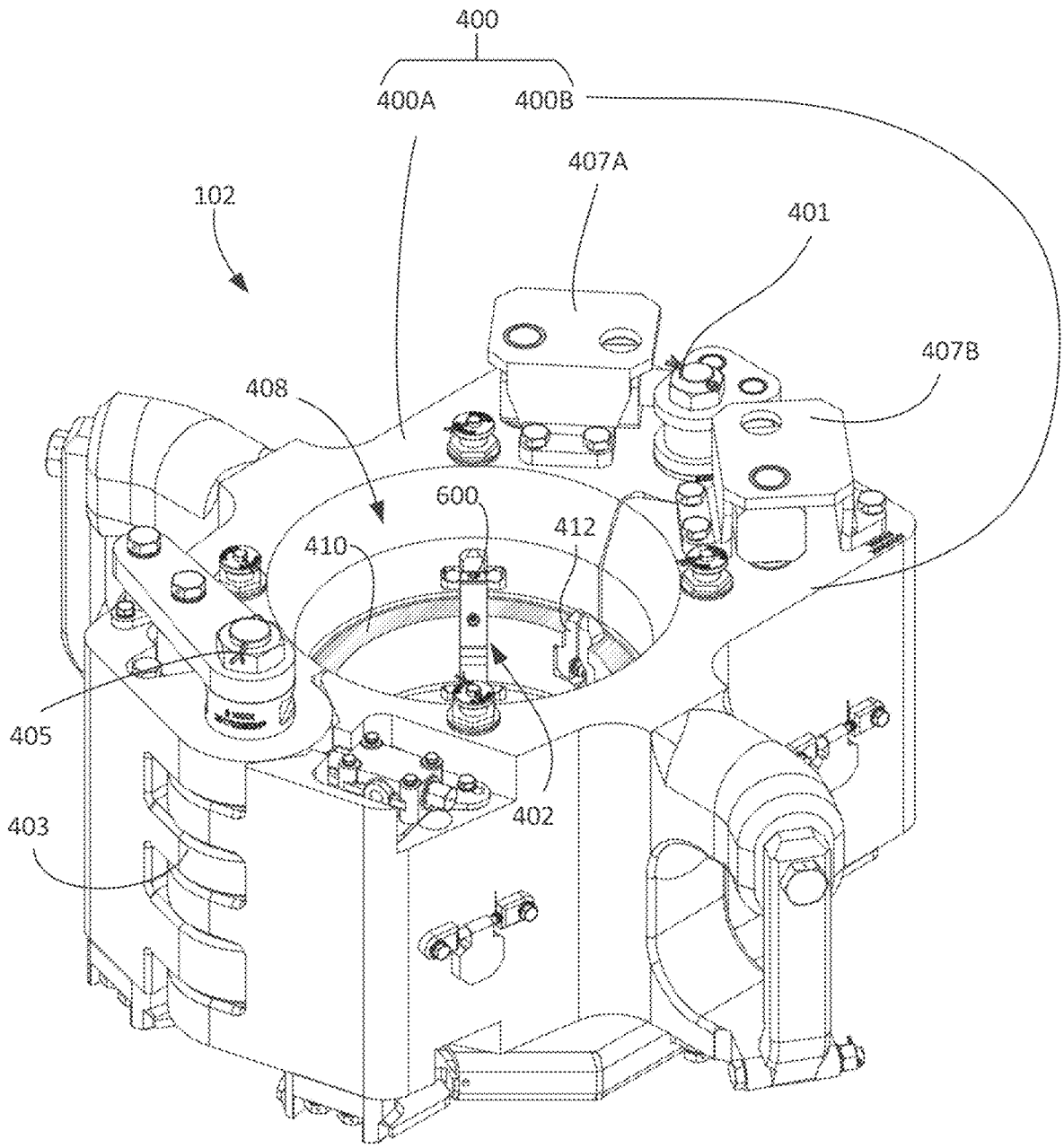
FIGS. 4 and 5 illustrate perspective views of an elevator in a closed position and an open position, respectively.
Figure 5:
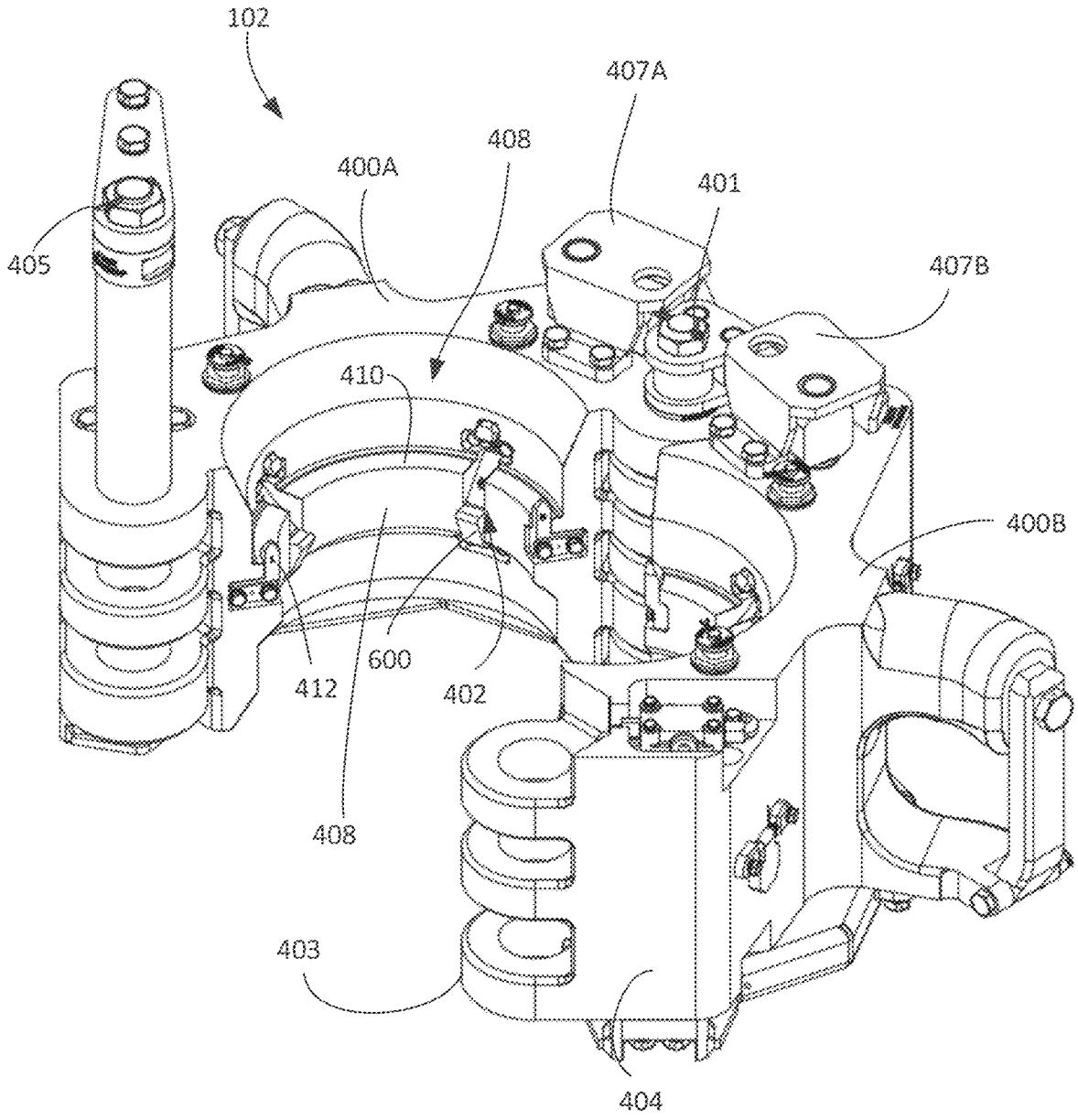

Turning now to the CLS elevator 102 that receives the load transfer bushing 100, FIGS. 4 and 5 illustrate perspective views of the elevator 102 in a closed position and an open position, respectively, according to an embodiment. The elevator 102 includes two arcuate body segments 400A and 400B, which may together form a body 400, and may be pivotal about a hinge pin 401, so as to move between the closed and open positions. Further, the arcuate body segments 400A, 400B may include a pad eye 403 that receives a latch pin 405, as shown. The elevator 102 may also include door cylinders 407A. 407B, which may control the opening and closing of the elevator 102. The opening and closing of the elevator 102 may be remotely actuated, e.g., via hydraulics, pneumatics, or any other medium.

The body 400 may define an axially-extending through-bore 408 therein. As shown, when the elevator 102 is closed, the through-bore 408 is generally cylindrical in shape, but when the elevator 102 is open, the through-bore 408 is accessible laterally through the body 400, allowing the elevator 102 to be received around a tubular. Within the through-bore 408, the body 400 may define an inwardly-protruding load support shoulder 410. The load support shoulder 410 may be annular and sized and configured to contact the bottom surface 219 (e.g., FIG. 3) of the load transfer bushing 100.

The elevator 102 may also include retainers 412, which may be positioned within the bore 408 and may extend upwards from the load support shoulder 410. The retainers 412 may be configured to be received into the slots 222, 224 (FIG. 3) formed in the circumferential ends of the first and second segments 200, 202 of the load transfer bushing 100. The segments 200, 202 may thus be connected to the body 400, so as to move therewith when the elevator 102 is opened and closed.

The elevator 102 may include a locking mechanism that is configured to retain the load transfer bushing 100 axially within the bore 408 and on the load support shoulder 410 until the load transfer bushing 100 is engaged and supported by the spear 106. In an embodiment, the locking mechanism may include a plurality of locking plates 600 positioned at angular intervals around the bore 408. In an embodiment, the locking plates 600 may be radially movable with respect to the body 400, e.g., into and out of pockets 402 formed therein. For example, the locking plates 600 may be biased radially inwards, e.g., springs that bear on the body 400. Further, the locking plates 600 may be positioned, for example, so as to align with the plate-receiving slots 208-214 of the load transfer bushing 100.

Figure 6:
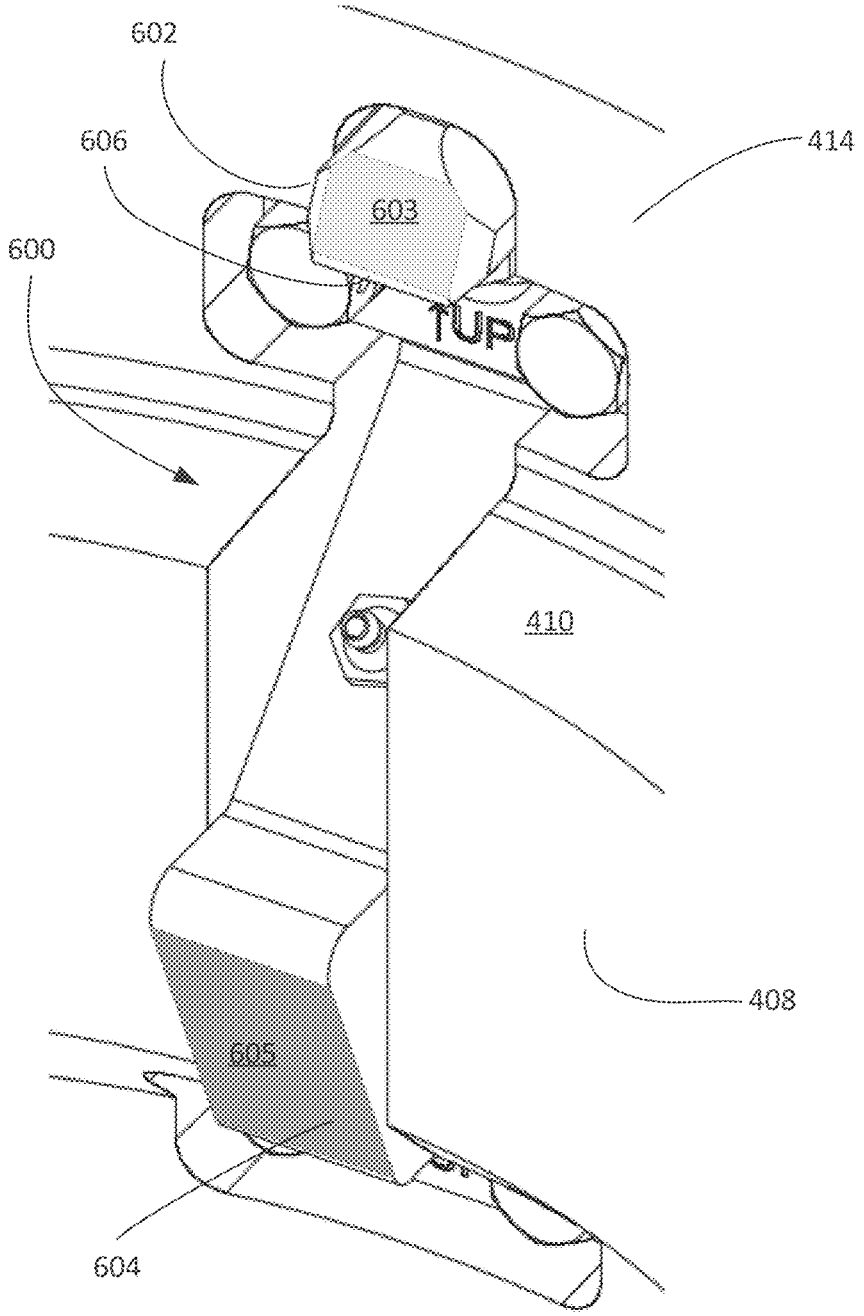
FIG. 6 illustrates an enlarged perspective view of a locking plate, according to an embodiment.

FIG. 6 illustrates an enlarged perspective view of one of the locking plates 600, according to an embodiment. As shown, the locking plate 600 may have two axially-offset engaging features 602, 604, which may extend radially inwards. Each of the engaging features 602, 604 may define a tapered engagement surface 603, 605, respectively. The upper engaging feature 602 may be positioned above the support shoulder 410, while the lower engaging feature 604 may be positioned below the shoulder 410.

The engagement surface 603 may be configured to engage the load transfer bushing 100, e.g., in one of the slots 208-214 (e.g., FIG. 3). For example, with additional reference to FIG. 3, the engagement surface 603 may be tapered, such that as the load transfer bushing 100 is received therein, the engagement surface 603 slides along the guide surface 226, pushing the locking plate 600 radially outwards with respect to the body 400, until the engaging feature 602 is received into one of the slots 208, latching into place. The engaging feature 602 may define a square shoulder 606, which, when received into the one of the slots 208-214, prevents the load transfer bushing 100 from moving axially upward and away from the support shoulder 410 unless locking plate 600 is withdrawn radially outward.

FIGS. 7A, 7B, 7C, and 7D illustrate partial, side, cross-sectional views of the load transfer bushing 100 being received into the elevator 102, and particularly illustrate an example of the operation of the locking plate 600. As shown, the locking plate 600 is positioned in the pocket 402 formed in the elevator body 400. The engagement surfaces 603, 605 on the respective engaging features 602, 604 extend inward into the bore 408 and 414. Further, the locking plate 600 movement may be constrained by a latch plate retainer pin 700 that is received axially through the body 400. The latch plate retainer pin 700 may be received in a pocket 710 formed in the locking plate 600. The pocket 710 and the latch plate retainer pin 700 may form a tapered interface 712, and the latch plate retainer pin 700 may be biased downwards, e.g., by a spring 701. Locking plate retainer springs 703 may also be provided, extending radially between the elevator body 400 and the locking plate 600 in the pocket 710, and biasing the locking plate 600 radially inwards. In some embodiments, the lath plate retainer pin 700 may be manually moved upwards, so as to allow the load transfer bushing 100 to be disengaged from the elevator 102, e.g., when the elevator 102 is in the open position.

When the locking plate 600 moves radially outwards, overcoming the biasing force applied thereto by the springs 701, 703, the latch plate retainer pin 700 moves upwards by the sliding engagement between the latch plate retainer pin 700 and the pocket 710 at the tapered interface 712, and the locking plate retainer springs 703 extend. When the radial outward force is removed, the springs 701, 703 force the locking plate 600 radially inwards, which also lowers the latch plate retainer pin 700.

An indicator post 702 may extend radially outwards from the locking plate 600, through an opening defined in the body 400. An indicator flapper 704 may be positioned on an outside of the body 400, e.g., in a highly-visible location, and may be engageable by the indicator post 702.

Figure 7A:
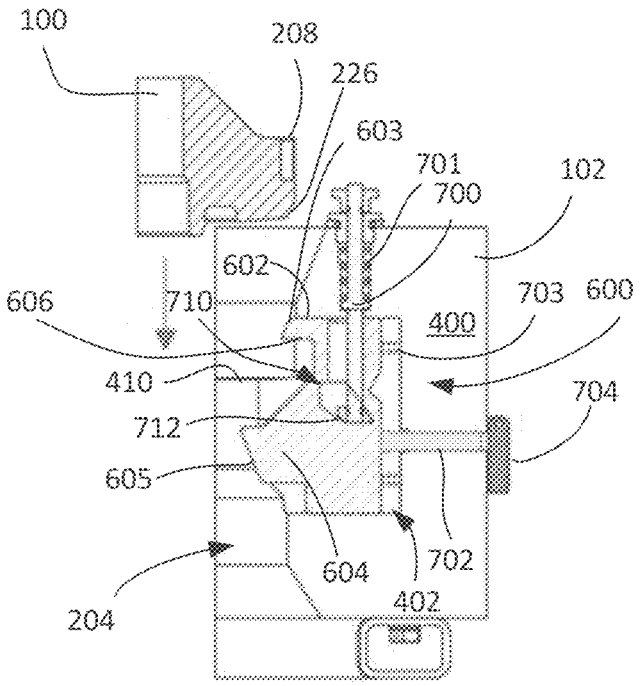
FIGS. 7A, 7B, 7C, and 7D illustrate partial, side, cross-sectional views of the load transfer bushing being received into the elevator, according to an embodiment.
Figure 7B:
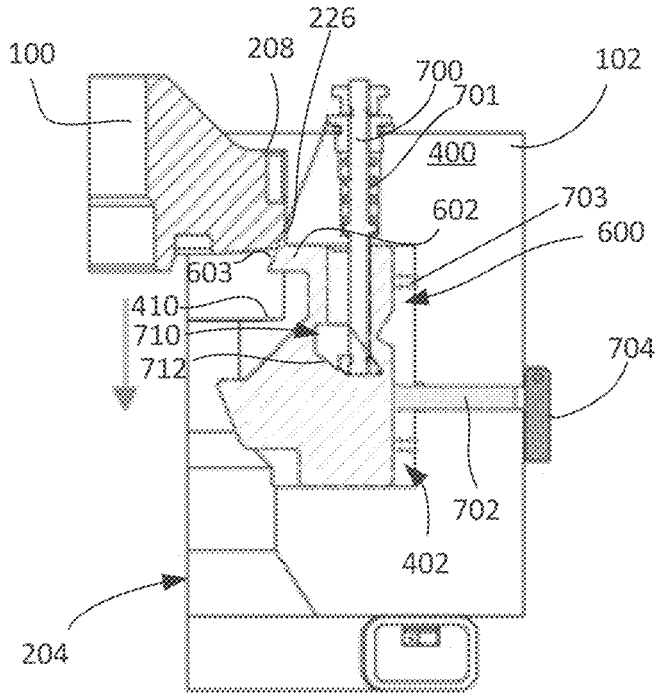
Figure 7C:
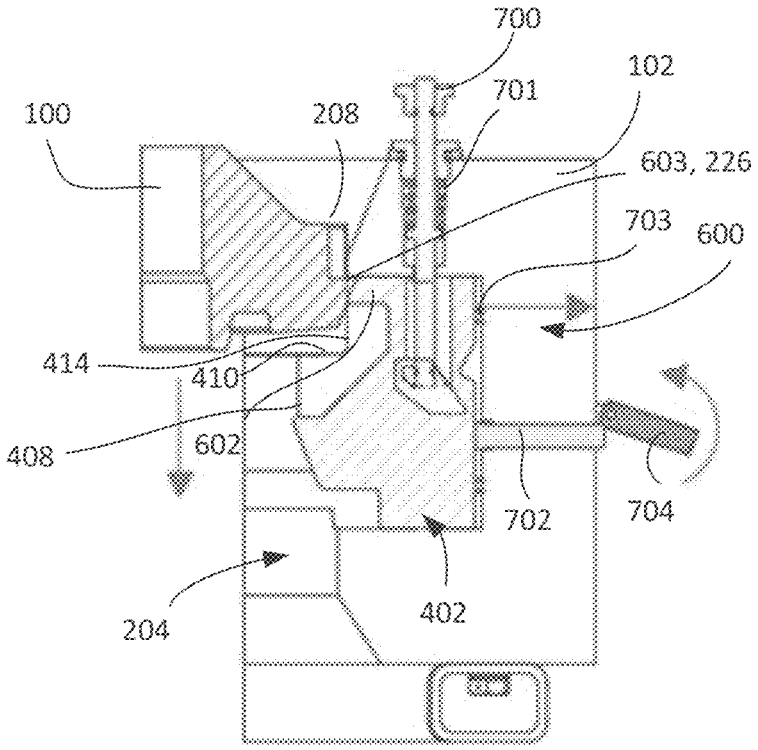
Figure 7D:
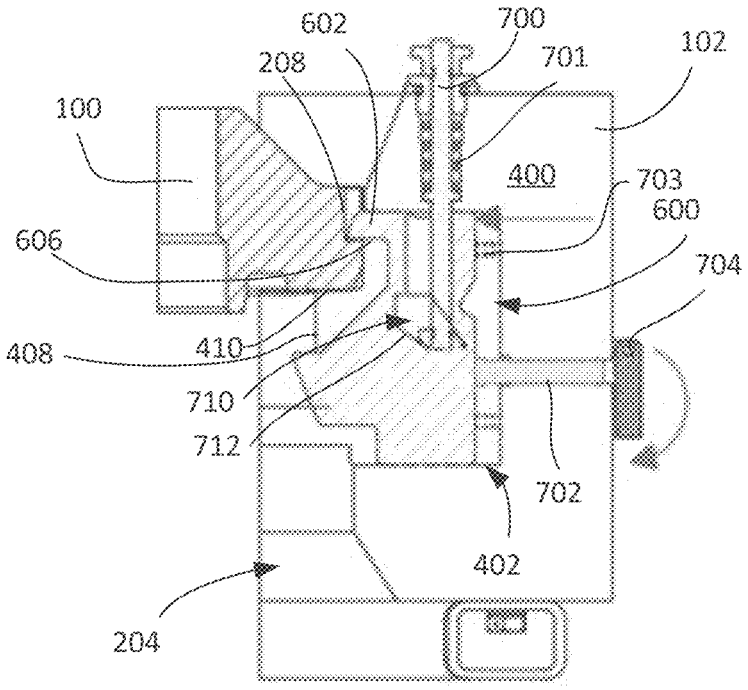

As the load transfer bushing 100 is received into a bore 414, as shown in FIG. 7B and progressing to FIG. 7C, the engagement surface 603 slides along the guide surface 226, pushing the locking plate 600 radially outwards. The outward movement of the locking plate 600 pushes the indicator post 702 into the indicator flapper 704, causing the indicator flapper 704 to pivot outwards, thereby providing a visible indication that the load transfer bushing 100 is not yet fully secured in the elevator 102. Progressing to FIG. 7D, the load transfer bushing 100 eventually contacts the support shoulder 410, and the engaging feature 602 is urged radially inward into the plate-receiving slot (e.g., slot 208). The locking plate 600 may be squared off on the lower side of the engaging feature 602, and the slot 208 may be likewise square. Thus, while the load transfer bushing 100 was easily received into the bore 414 by the tapered engaging surfaces 226, 603 sliding the locking plate 600 radially outwards, such radial movement is not provided in the opposite direction between the square, axially-facing engaging feature 602 and the slot 208. As such, the locking plate 600 interlocks with the load transfer bushing 100, ensuring that the load transfer bushing 100 is prevented from moving away from the support shoulder 410.

Figure 8:
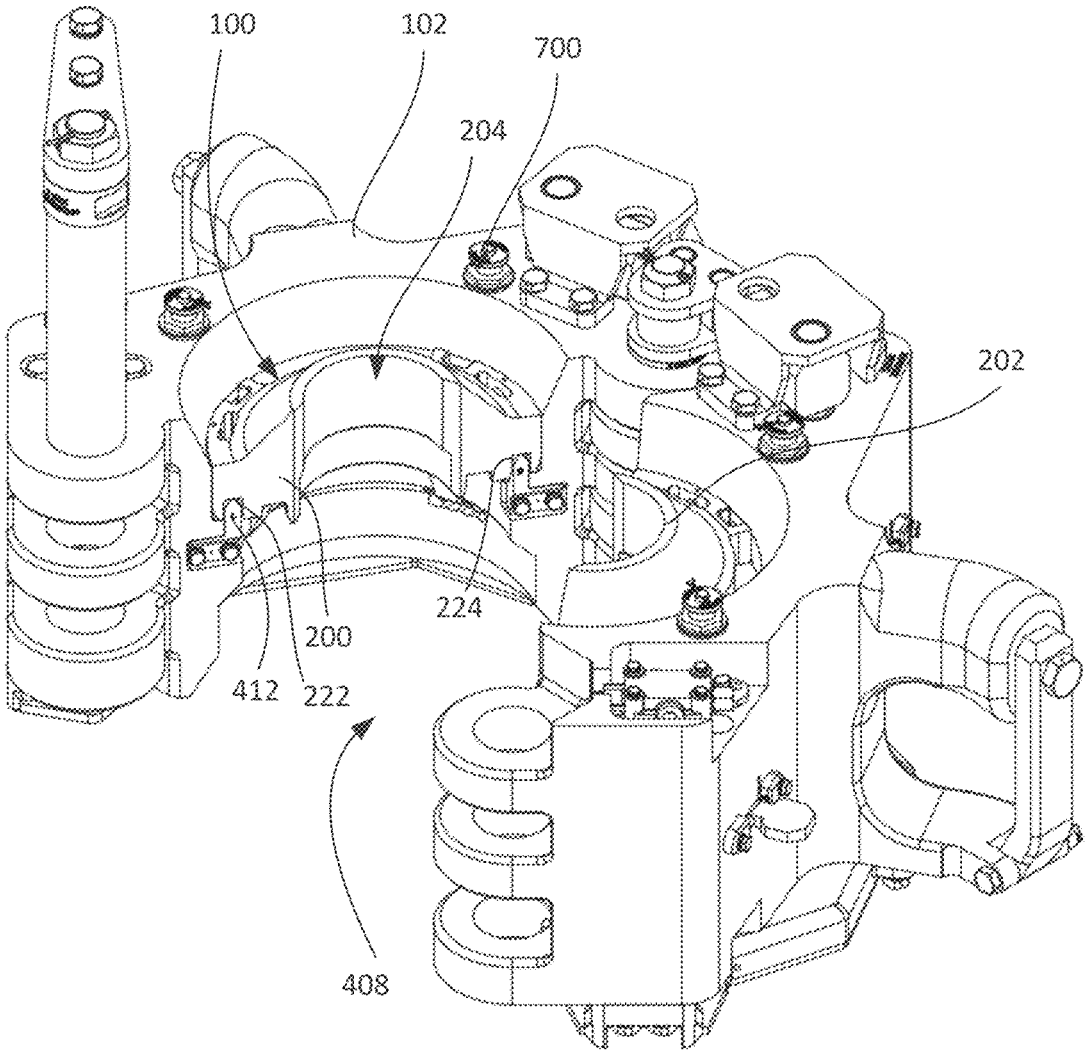
FIG. 8 illustrates a perspective view of the elevator in an open position with the load transfer bushing positioned therein, according to an embodiment.
Figure 9:
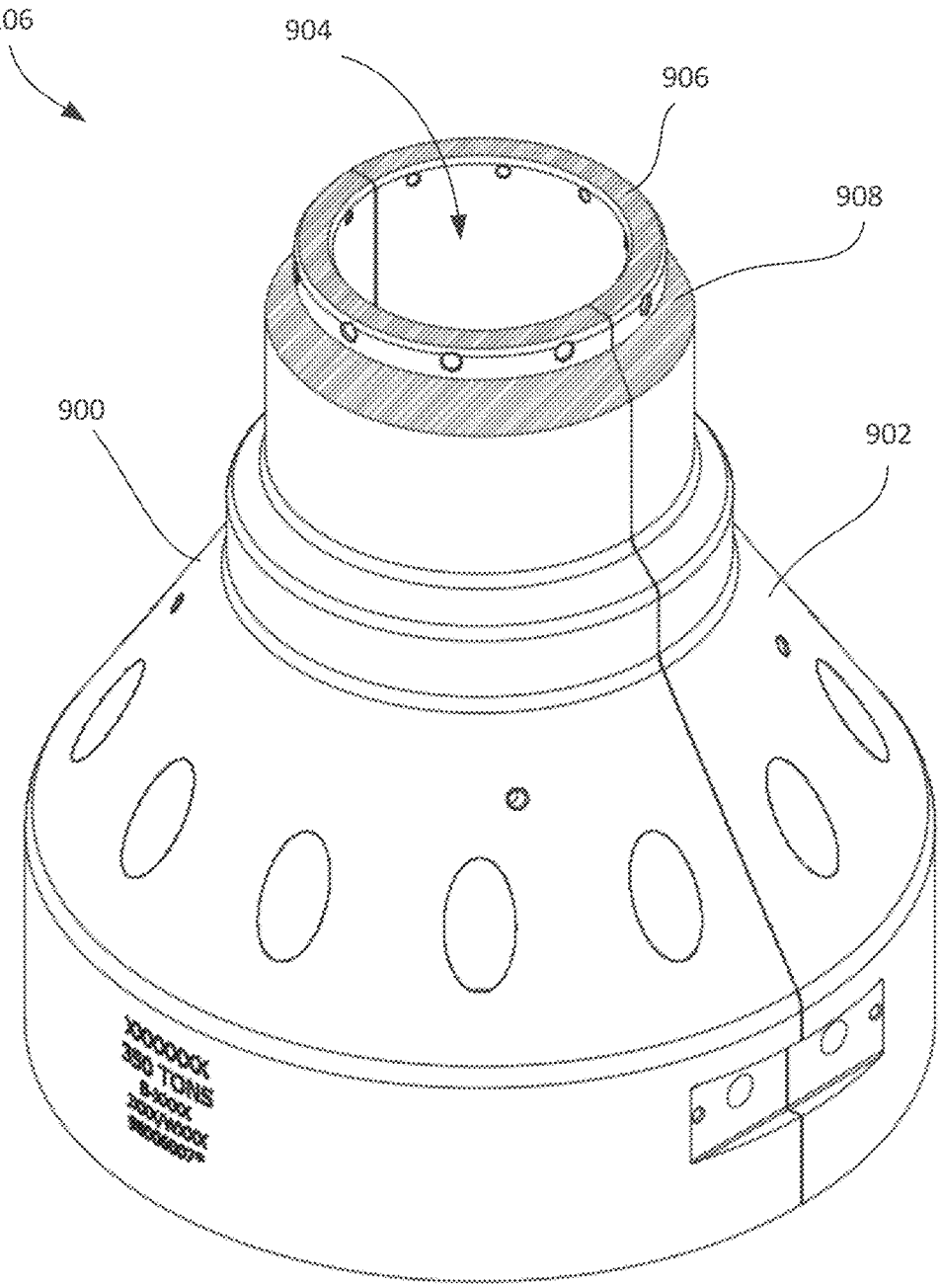
FIG. 9 illustrates a perspective view of a spear, according to an embodiment.

FIG. 8 illustrates a perspective view of the elevator 102 in an open position with the load transfer bushing 100 positioned therein. As can be seen, the load transfer bushing 100 is received into the bore 414 and supported on the support shoulder 410. Further, the retainers 412 are received into the slots 222, 224, thereby holding the segments 200, 202 radially and circumferentially in place, with the periphery 215 (FIGS. 2 and 3) against the bore 414. As mentioned above, the segments 200, 202 may not be connected together, and thus may separate and move along with the elevator body halves 400A and 400B opening and closing. As such, in the illustrated open position, the elevator 102 and the load transfer bushing 100 may laterally receive a tubular into the bore 408 of the elevator 102 and the bore 204 of the load transfer bushing 100. In some embodiments, once the segments 200, 202 of the load transfer bushing 100 have been secured in place by the locking plates 600, lifting the pin 700 results in the radially outward movement of plate 600, which disengages the engaging feature 602 from slot 208. This allows the segment 200, 202 to be lifted vertically upward and away from the shoulder 410 of the elevator 104. As such, the load transfer bushing 100 may be disengaged manually via the latch plate retainer pin 700, while the elevator 102 is in either the open or closed position Referring again to FIG. 6, the engagement surface 605 may be positioned at the lower end of the locking plate 600 and may also be tapered, but in a reverse orientation to the engagement surface 603. Referring now additionally to FIG. 9, there is shown a perspective view of the spear 106, according to an embodiment. The spear 106 may include two (or potentially more) sections 900, 902, which are pivotal or otherwise movable apart, and a central bore 904 defined by the sections 900, 902 through which the tubular may extend. The spear 106 also defines a top surface 906 and a tapered locking plate contact surface 908. The top surface 906 may be receivable against the spear contact surface 216, in the annular groove 220 in the load transfer bushing 100 (e.g., FIG. 3). Further, the locking plate contact surface 906 may contact the engagement surface 605 of the locking plate 600 (e.g., FIG. 6). As the engagement of the locking plate 605 engages the surface 908 of the spear 106, the locking plate 600 is again pushed radially outwards with respect to the body 400, which causes the engaging feature 602 to move out of engagement with slots 208, 210, 212, and 214. Activation (e.g. simultaneous) of all four locking plates releases the load transfer bushing 100 from the elevator 102, thereby allowing displacement of the load transfer bushing 100 relative to the support shoulder 410.

Figure 10A:
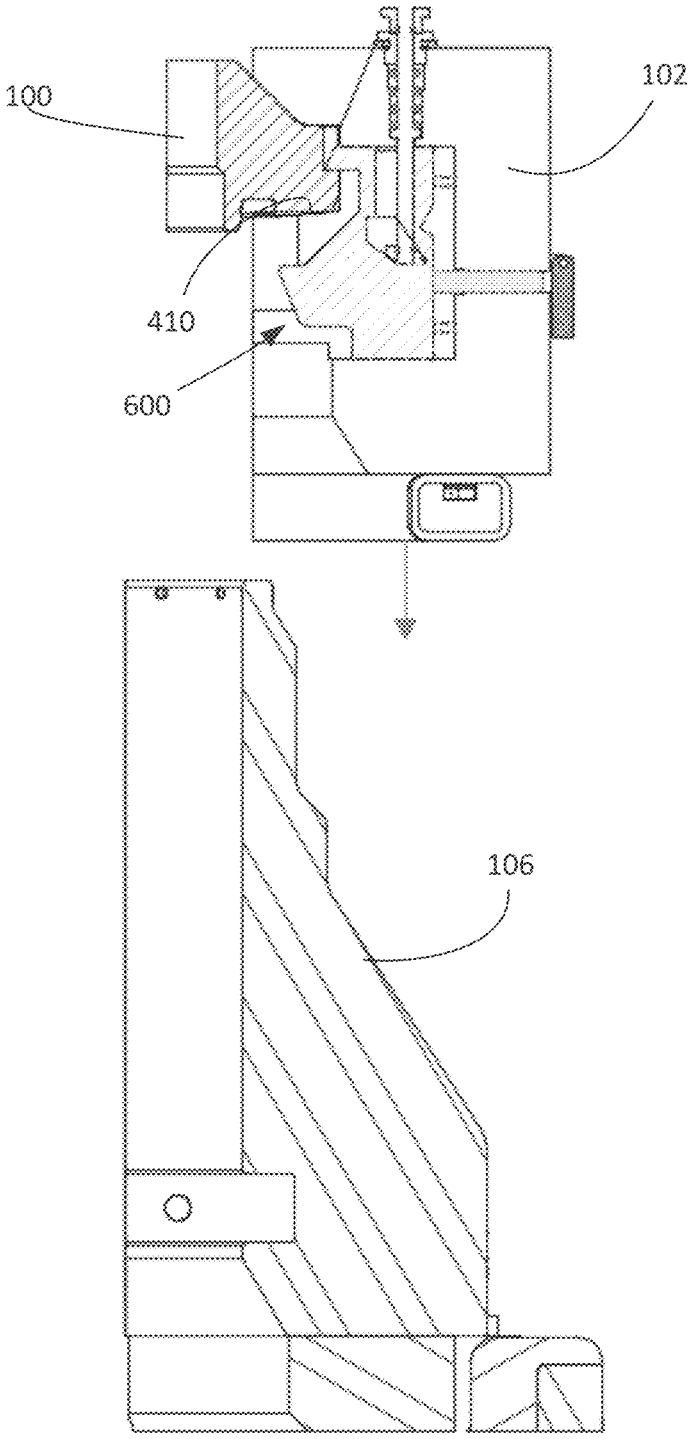
FIGS. 10A, 10B, and 10C illustrate side, partial, cross-sectional views of the load transfer bushing and the elevator being lowered onto the spear, according to an embodiment.
Figure 10B:
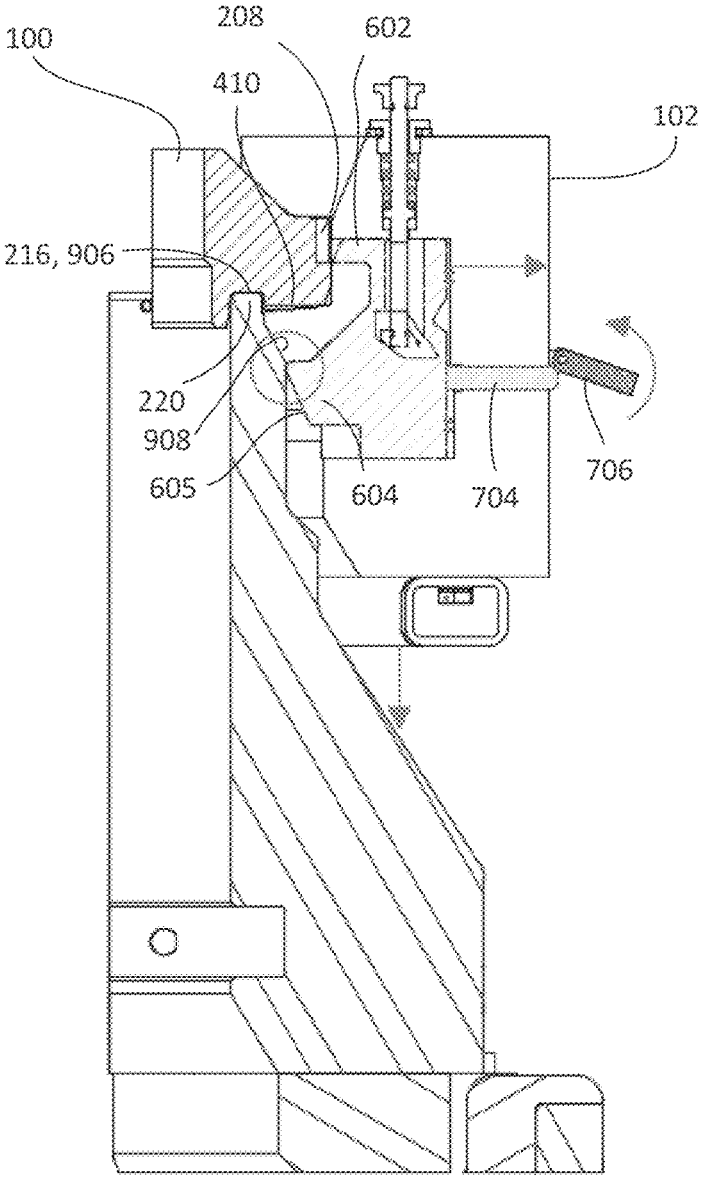
Figure 10C:
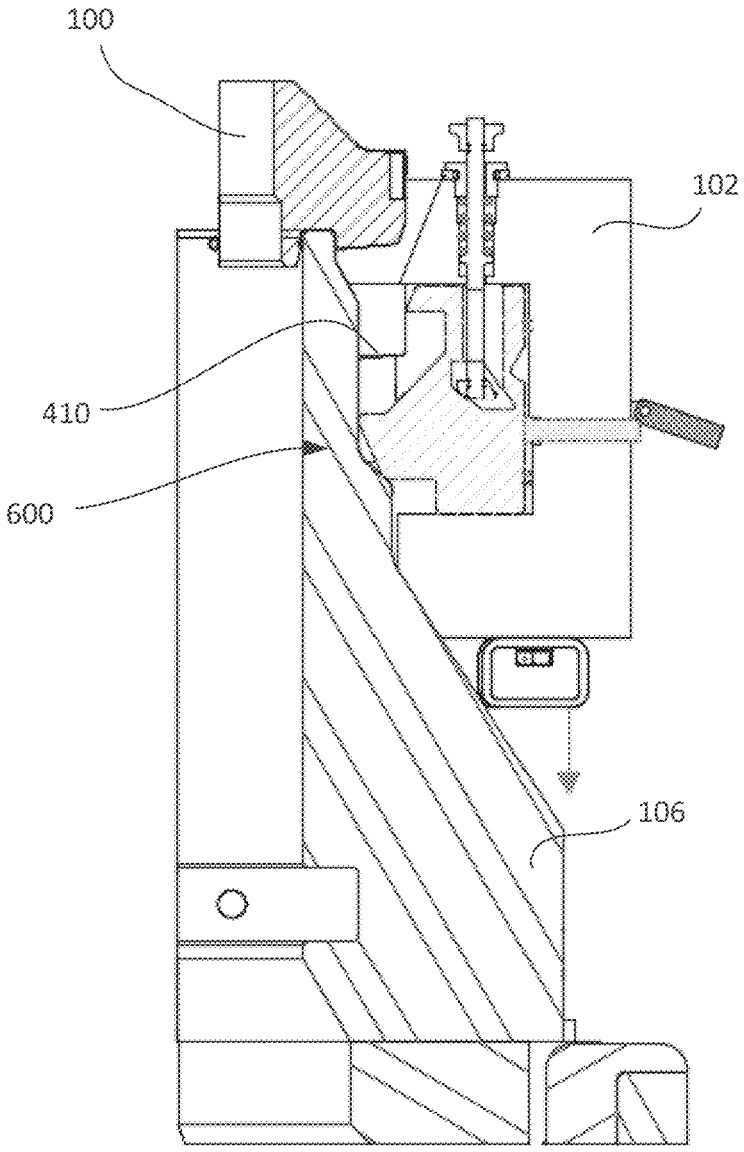

FIGS. 10A, 10B, and 10C illustrate side, partial, cross-sectional views of the load transfer bushing 100 and the elevator 102 being lowered with respect to the spear 106, according to an embodiment. In particular, FIGS. 10A-10C illustrate the movement of the elevator 102 with respect to the spear 106 causing the locking mechanism to disengage and the load transfer bushing 100 to be displaced from the elevator 102, and thus effecting a load handoff between the elevator 102 and the spear 106. As shown in FIG. 10A, the elevator 102, with the load transfer bushing 100 therein (which may be engaging the tubular, although this is not shown in this view), may be lowered toward the spear 106. As shown in FIG. 10B, the lower engagement surface 605 may eventually bear upon the tapered surface 908 of the spear 106, pushing the locking plate 600 radially outwards with respect to the body 400 of the elevator 102. This radial movement may move the upper engaging feature 602 out of the slots 208, 210, 212, and 214 releasing the locking plate 600 from the load transfer bushing 100. This may also cause the indicator post 704 to engage the indicator flapper 706 and indicate that the load transfer bushing 100 is not seated against the shoulder 410.

Further, the load transfer bushing 100 is landed on the top surface 906 of the spear 106 at this point. In particular, according to an embodiment, the top surface 906 is received into the annular groove 220 and positioned against the spear contact surface 216 of the load transfer bushing 100. The inner contour 218 is thus received within the top of the bore 904 of the spear 106.

As the elevator 102 is continued to be lowered, with the locking plate 600 no longer preventing displacement of the load transfer bushing 100, and the load transfer bushing 100 landed on the spear 106, the elevator 102 continues its downward movement without the load transfer bushing 100, as shown in FIG. 10C. The elevator 102 may land on another surface of the spear 106, as shown, or may be otherwise stopped. At this point, the elevator 102 may be opened, removed from around the spear 106 by laterally moving the elevator away from well center by using the rig's elevator link tilt mechanism, closed, and another load transfer bushing (e.g., bushing 104 from FIG. 1) loaded therein.

Figure 11:
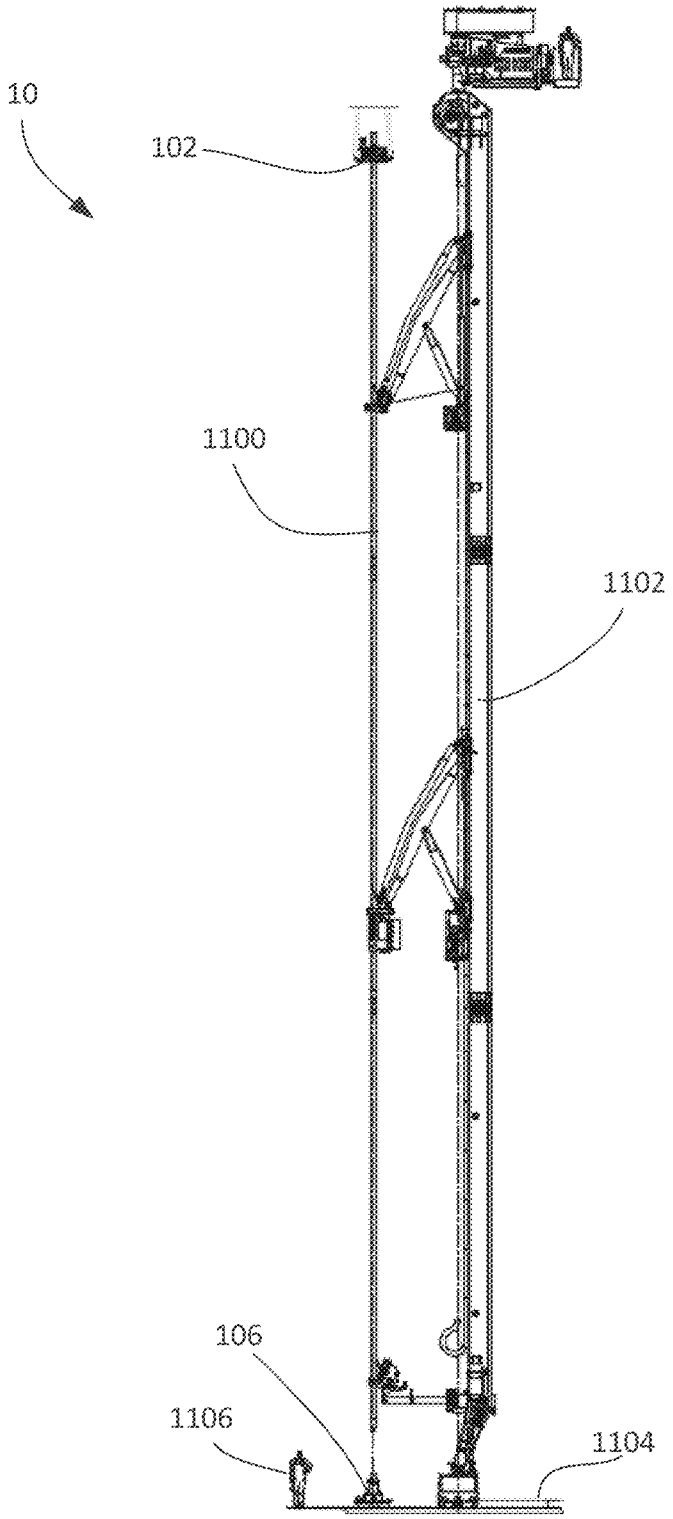
FIG. 11 illustrates a side, elevation view of the load transfer system in the context of a stand of tubulars, according to an embodiment.

FIG. 11 illustrates a side, elevation view of the load transfer system 10 in the context of a stand of tubulars 1100, according to an embodiment. The stand of tubulars 1100 is maintained in a vertical orientation and presented to the well center by a pipe racking system 1102. As mentioned above, the elevator 102 may be remotely actuated between the open and closed positions, and the load transfer bushing 100 (inside the elevator 102) may open along with the elevator 102. Thus, the elevator 102 may be hoisted to a point near the top of the stand 1100, well above the rig floor 1104, where an operator 1106 could not physically reach. The elevator 102 along with load transfer bushing 100 can be hinged open and subsequently placed around the stand 1100 to attach itself and the load transfer bushing 100 around the stand 1100 proximal to (e.g., engaging) an upper collar or another upset of the tubular stand 1100.

Figure 12:
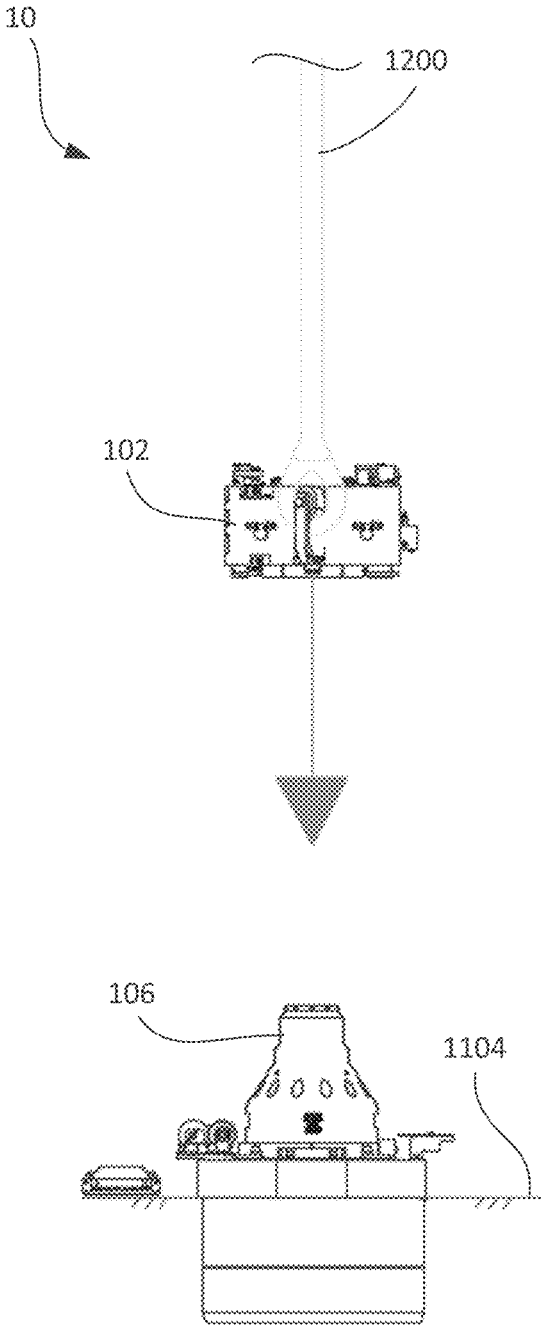
FIGS. 12, 13, 14, 15, 16, 17, 18, 19, 20, 21, 22, 23, 24, 25, 26, and 27 illustrate an example of an operation sequence for the load transfer system, according to an embodiment.
Figure 13:
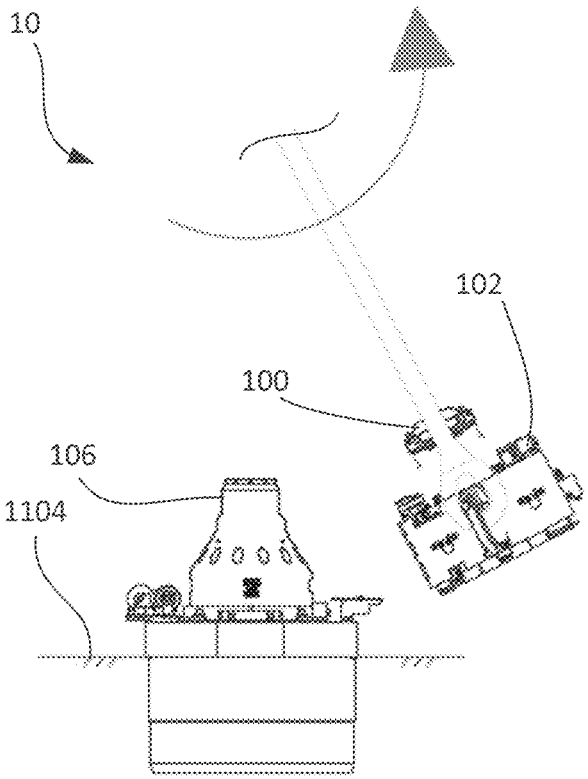

The sequence of operation of the load transfer system 10 may now be understood. FIG. 12 illustrates a side, elevation view of the load transfer system 10 at the commencement of the sequence, according to an embodiment. The elevator 102, supported on a pair of bails 1200, may be lowered toward the spear 106 positioned at or near the rig floor 1104. As shown in FIG. 13, the elevator 102 may be swung away from the spear 106, allowing a rig operator to position the load transfer bushing 100 within the elevator 106, e.g., by inserting from above the elevator 102 and between the bails 1200. As described above, the load transfer bushing 100 may be landed on the shoulder 410 and locked therein by the locking mechanism (e.g., locking plates 600).

Figure 14:
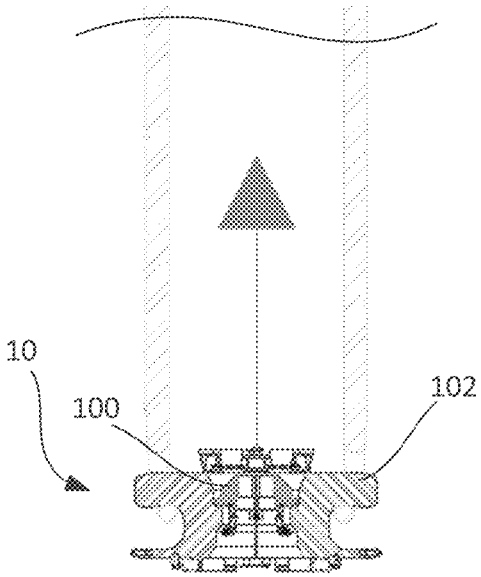
Figure 14:
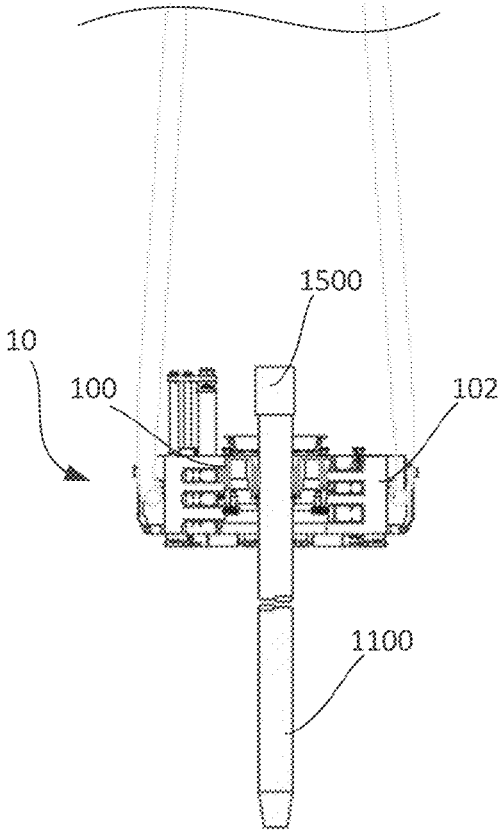
Figure 14:
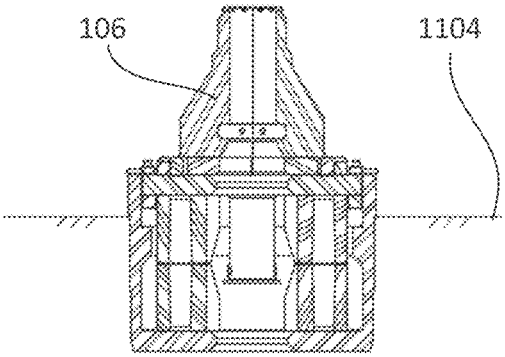
Figure 15:
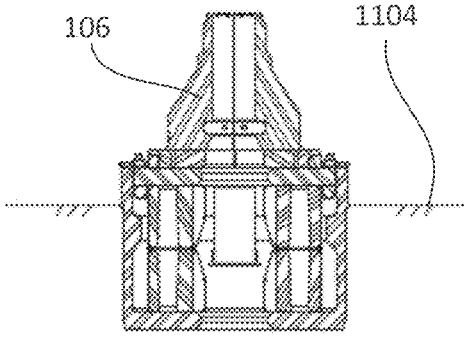

Next, as shown in FIG. 14, the elevator 102, still not attached to a tubular, but with the load transfer bushing 100 positioned therein, may be raised to the top of the stand 1100 (FIG. 11). As shown in FIG. 15, the elevator 102 may be opened, and may laterally receive the stand 1100 therein (refer to the open position with the load transfer bushing 100 shown in FIG. 8), e.g., at a position immediately below an upset 1500 of the stand 1100 (e.g., part of the tubular, or a coupling attached thereto). In this embodiment, the upset 1500 is represented as a collar, but could be integral with the tubular. In other embodiments, the upset 1500 may be provided by any suitable load contact surface.

Figure 16:
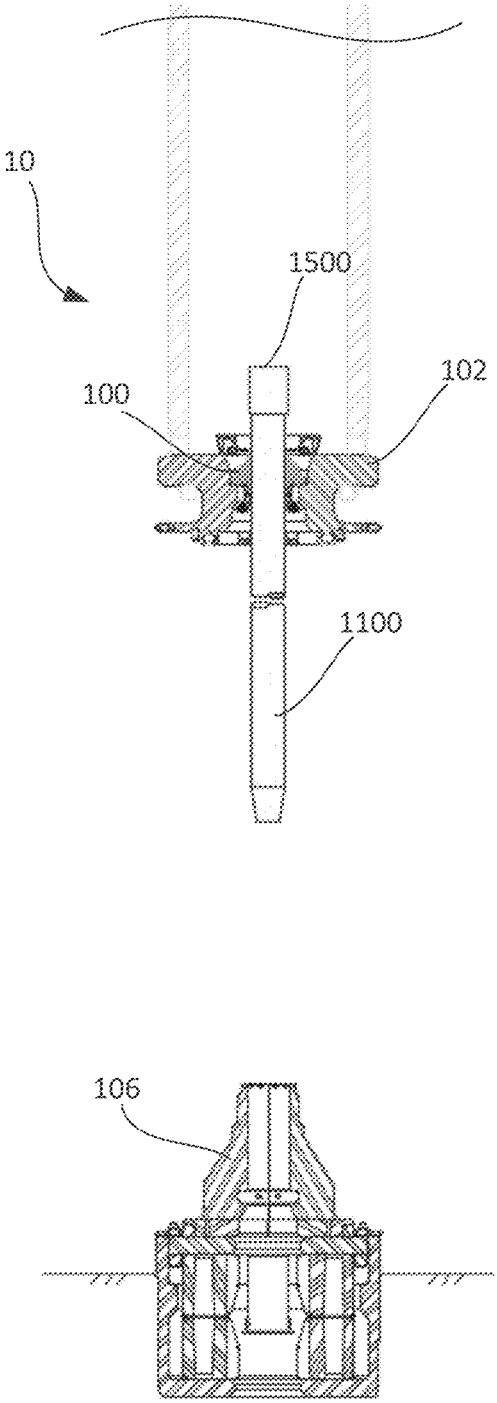

As shown in FIG. 16, the elevator 102, along with the load transfer bushing 100, near the top of the stand 1100, may then be remotely actuated to close around the stand 1100, thereby positioning the load transfer bushing 100 around the stand 1100, below the upset 1500.

Figure 17:
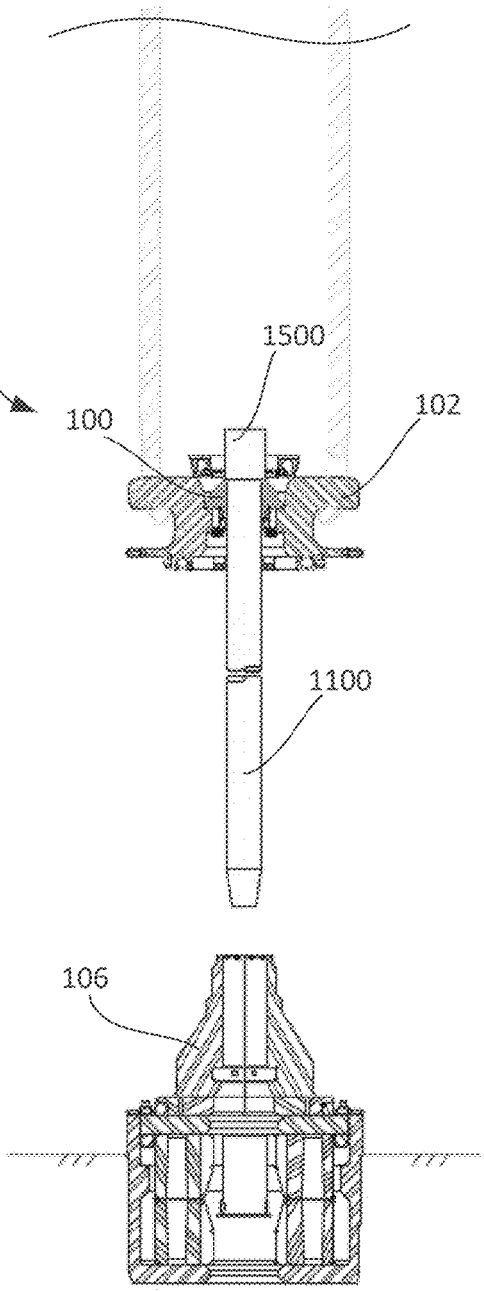

As shown in FIG. 17, the elevator 102 may be further raised with respect to the stand 1100 until surface 206 of the load transfer bushing 100 axially engages the lower axial support surface of upset 1500. The elevator 102 may then be still further raised, if needed, thereby lifting the stand 1100.

Figure 18:
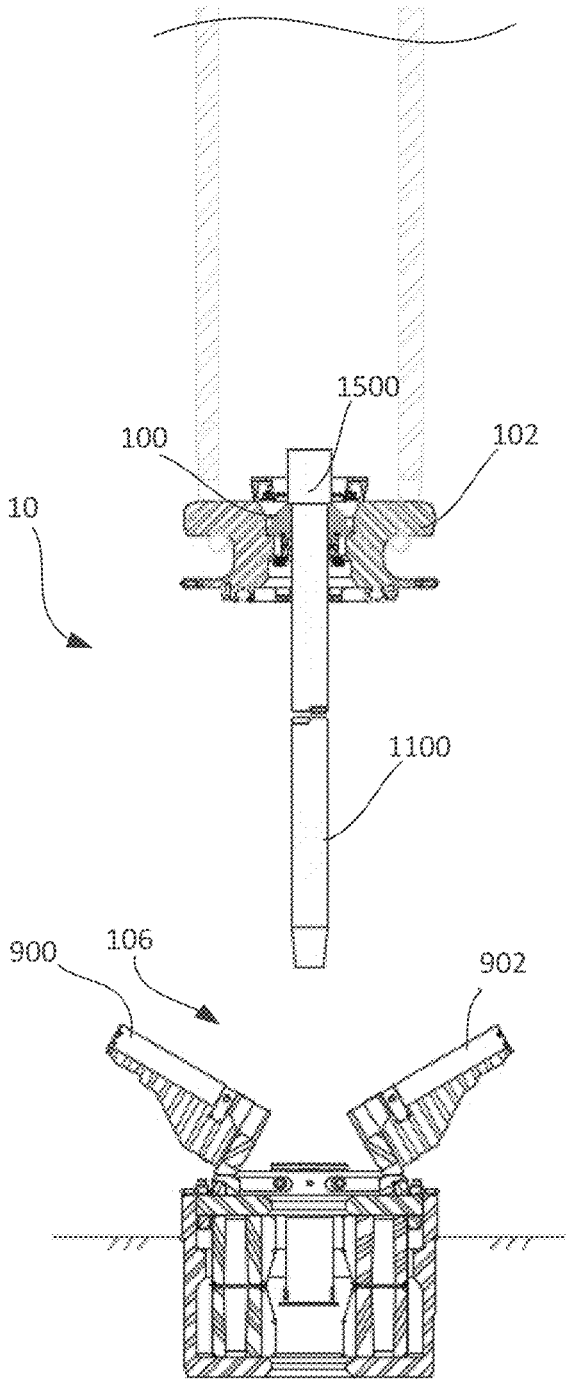
Figure 19:
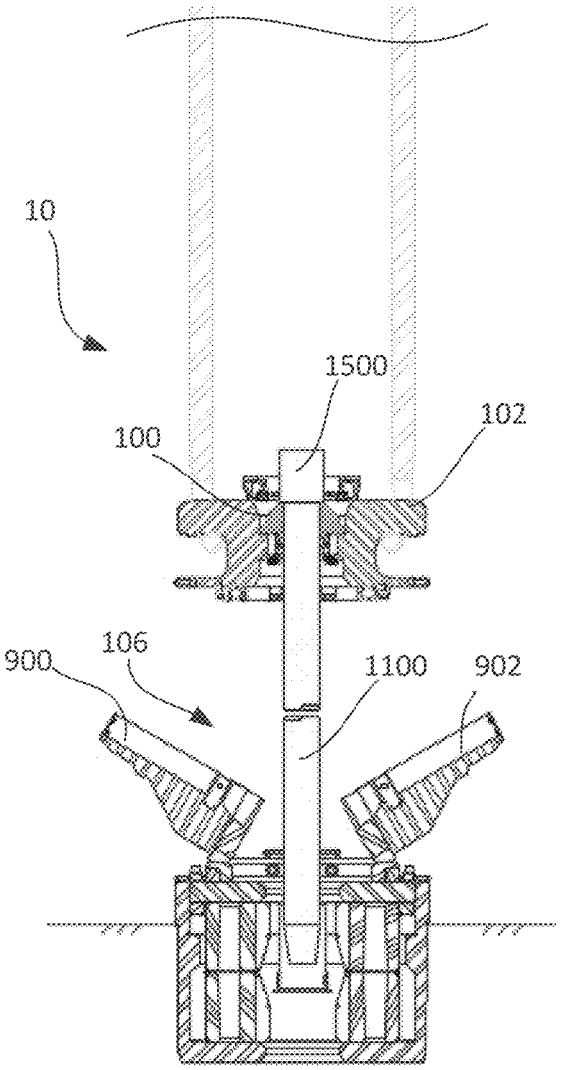
Figure 20:
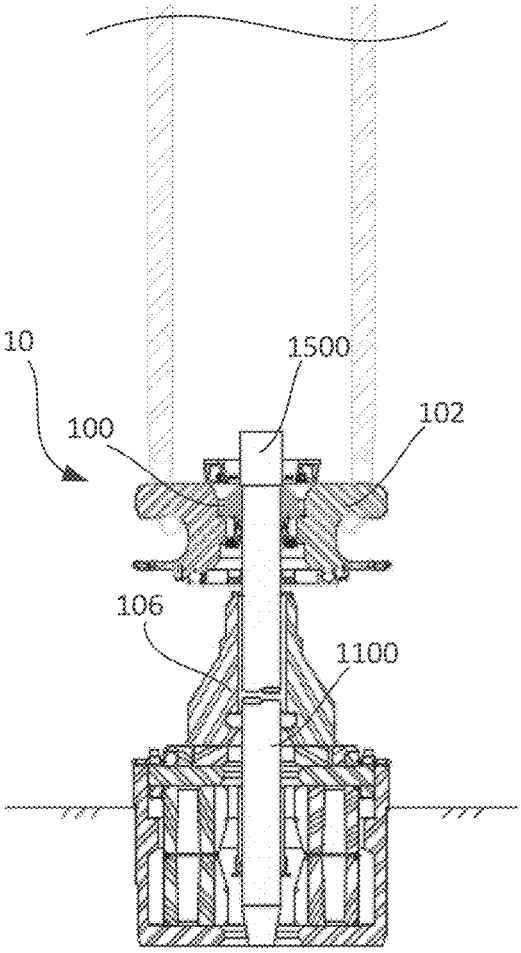
Figure 21:
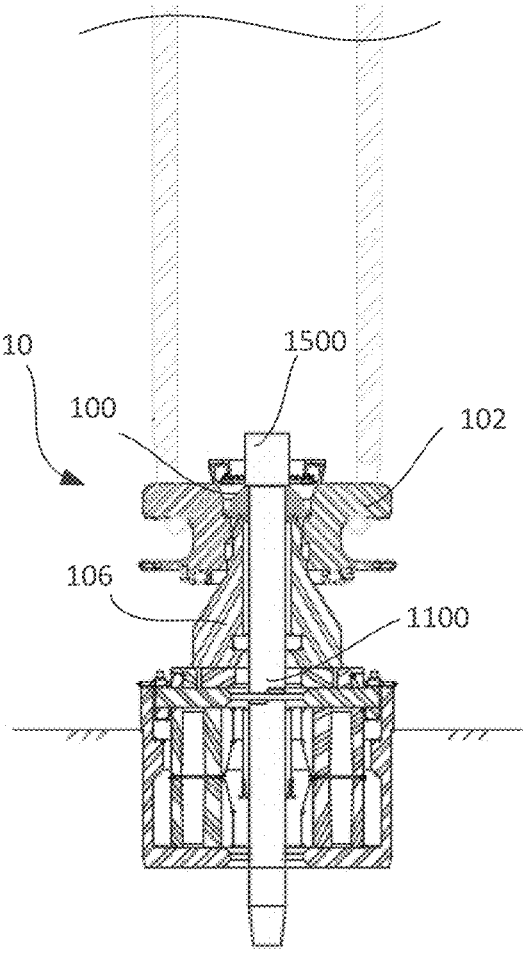
Figure 22:
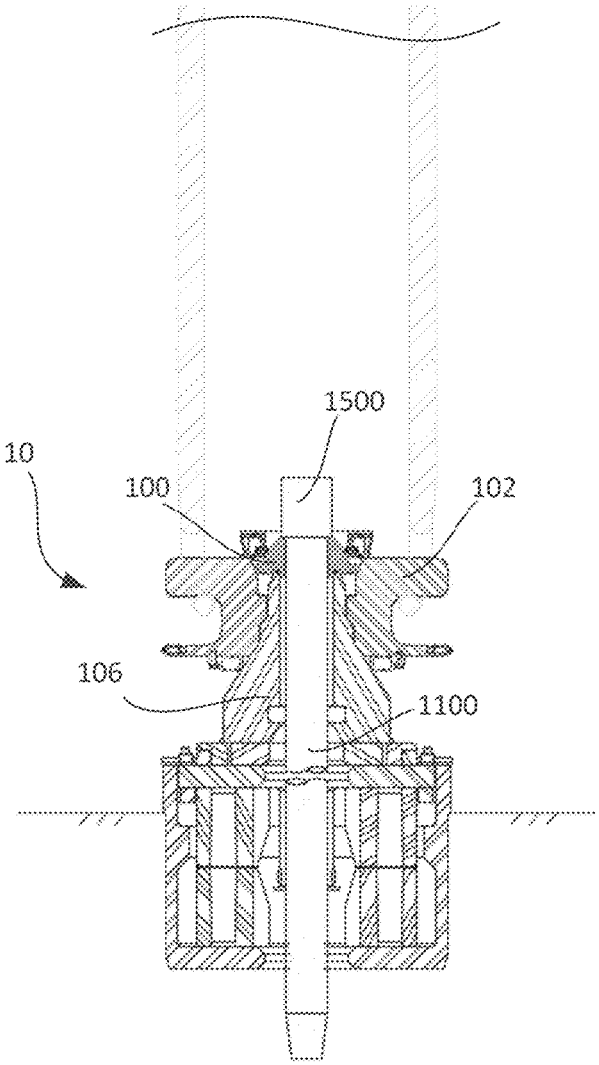

As shown in FIG. 18, the spear sections 900, 902 may be moved apart, and the elevator 102, supporting the stand 1100, is then moved downwards, deploying the tubular string into the wellbore. Moving to FIG. 19, as the elevator 102 approaches the spear 106, the lowering of the elevator 102 may be halted, and the spear 106 may be closed, as shown in FIG. 20. With the spear 106 closed, the elevator 102 may continue to move downward over the top of the spear 106, as shown in FIG. 21. As explained above, the movement of the elevator 102 over the spear 106 causes the load transfer bushing 100 to land on the spear 106, and, as shown in FIG. 22, further movement causes load transfer bushing 100 to be displaced axially from the elevator support shoulder 410.

Figure 23:
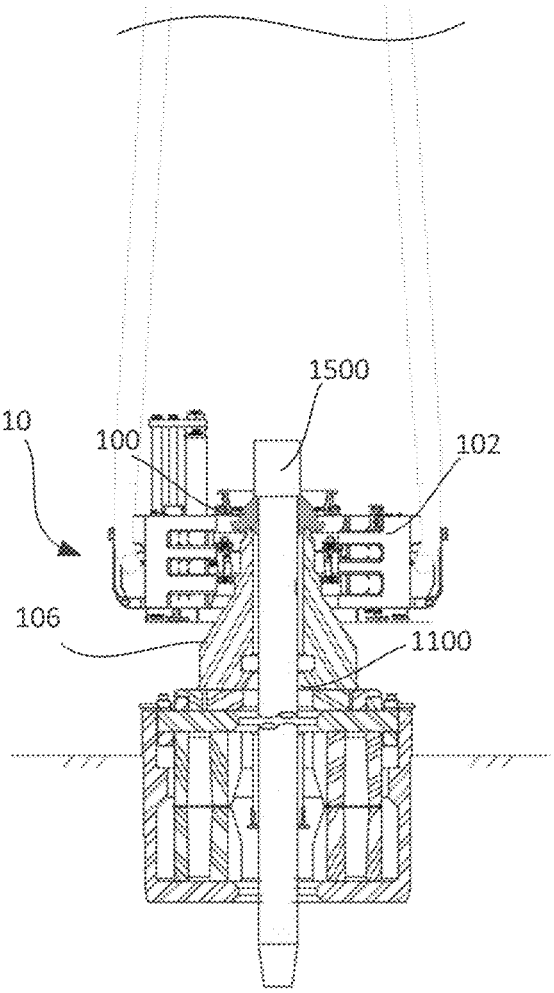
Figure 25:
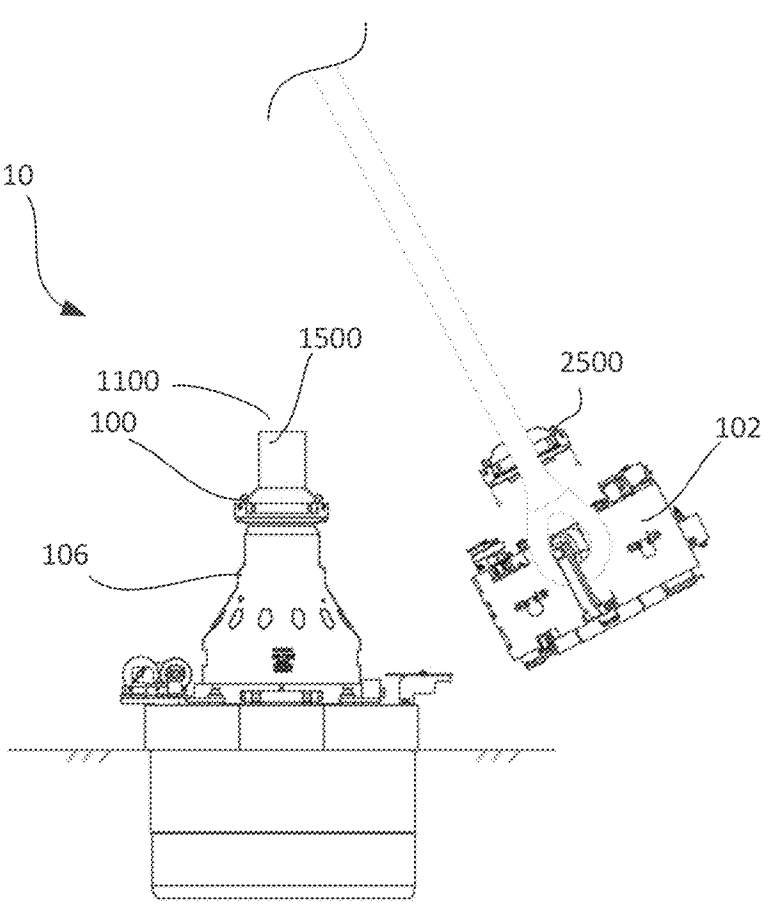
Figure 24:
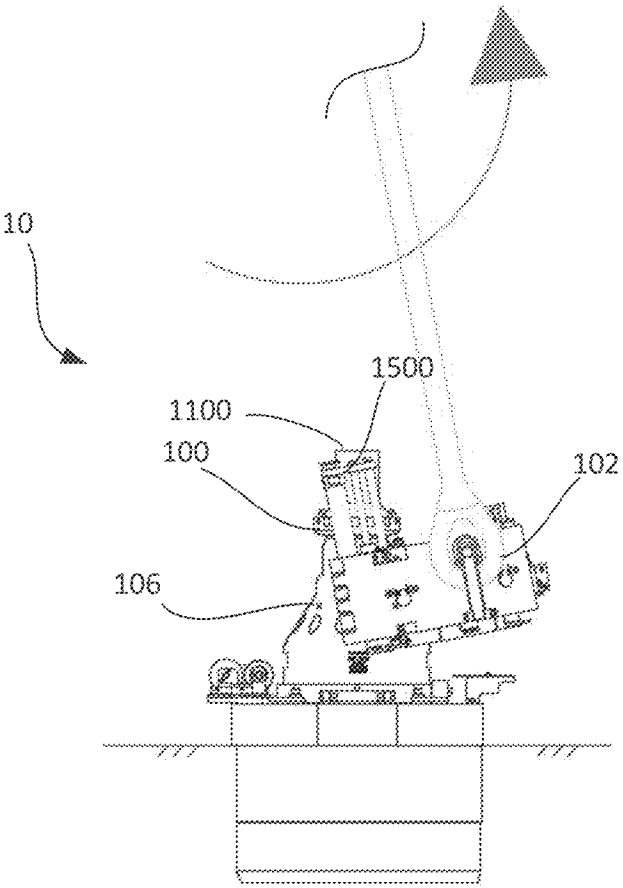
Figure 26:
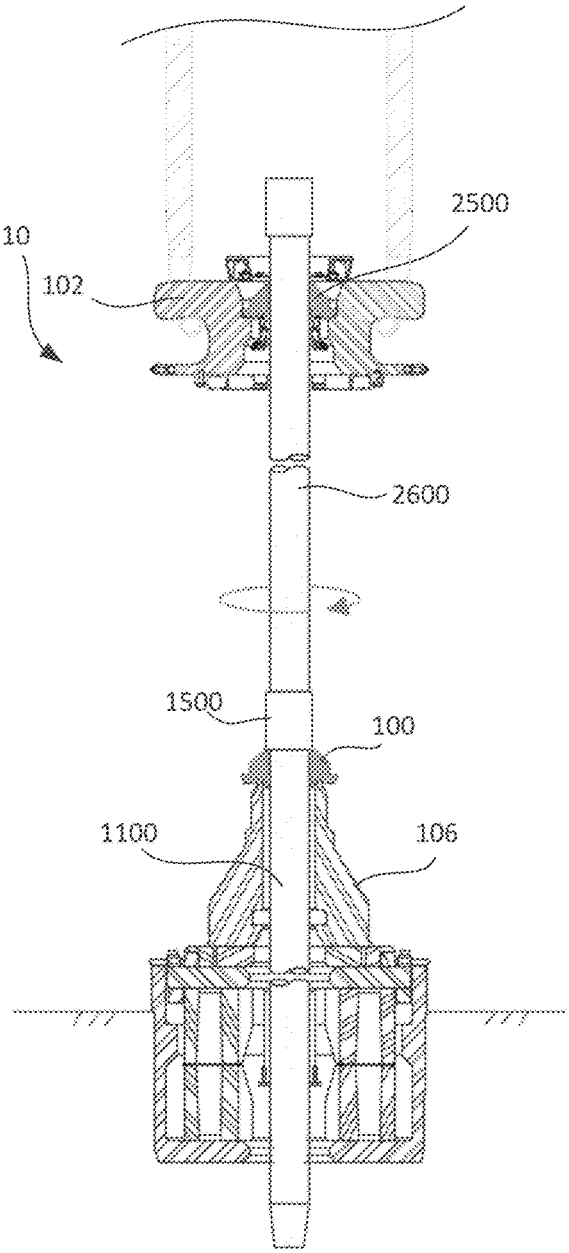
Figure 27:
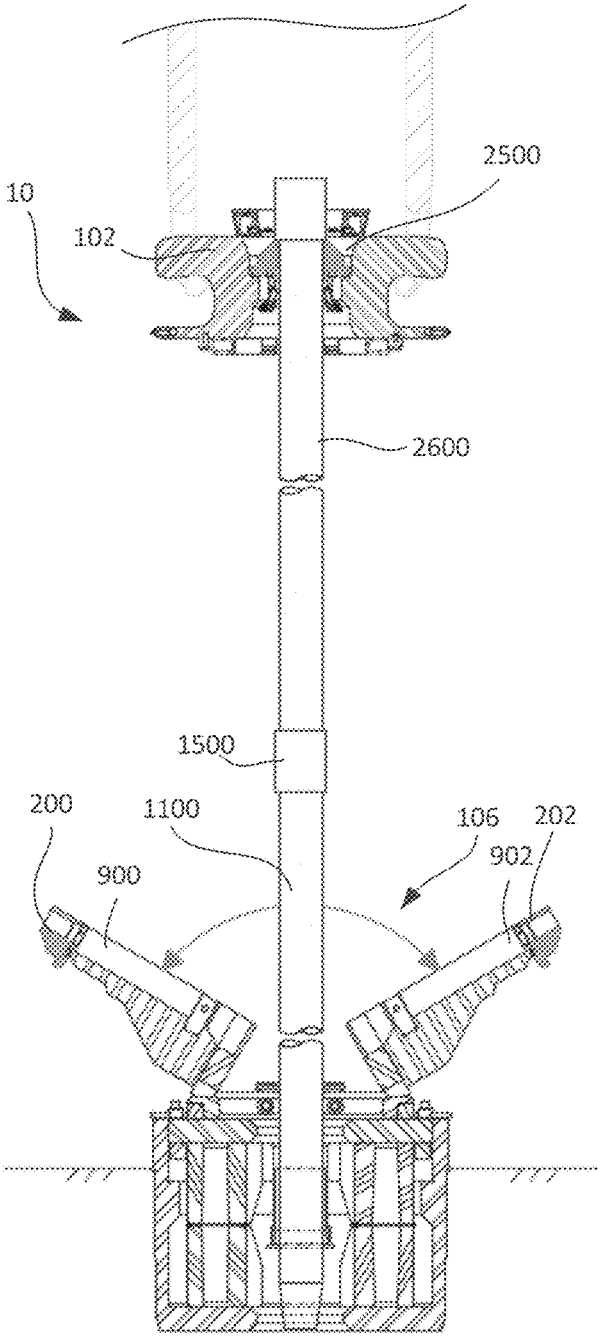

The elevator 102 may then be opened, as shown in FIG. 23, and tilted away from the spear 106, as shown in FIG. 24, thereby removing the elevator 102 from around the spear 106. Another load transfer bushing 2500, which may be identical to the load transfer bushing 100, may then be loaded into the elevator 102, as shown in FIG. 25. As shown in FIG. 26, the elevator 102 may then move upward to engage the next stand 2600, as described for the previous stand 1100. The next stand 2600 may be made-up to the previously-run stand 1100, and once the connection is made, the elevator 102, engaging the stand 2600, which also supports the stand 1100, may then lift the stands 1100, 2600 upwards, such that the load transfer bushing 100 is no longer supporting the stand 1100 on the spear 106. With the spear 106 no longer supporting the weight of the stand 1100, the spear 106 may be opened, as shown in FIG. 27, to allow the elevator 102 to lower the stand 2600 therethrough. Opening the spear 106 may also separate apart the segments 200, 202 of the load transfer bushing 100, which may then be removed by an operator at the rig floor 1104 and subsequently re-used for engaging the next stand.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A load transfer system for oilfield tubulars, the system comprising:

a load transfer bushing comprising a first arcuate segment and a second arcuate segment, the first and second arcuate segments being configured to engage a load surface of a tubular or of a collar connected to the tubular;

a floor mounted support structure positioned at a rig floor and through which the tubular is received; and an elevator suspended from a rig and configured to receive the load transfer bushing so as to support the tubular via engagement with the load transfer bushing, the elevator having an open position and a closed position, wherein moving the elevator from the closed position to the open position while the elevator engages the load transfer bushing moves the first and second arcuate segments apart, so as to permit the elevator and the load transfer bushing to be received around the tubular, wherein moving the elevator from the opened position to the closed position with the load transfer bushing and elevator surrounding the tubular forms an axial engagement load surface for the load surface of the tubular or the collar, and wherein the load transfer bushing is disengageable from the elevator, wherein the load transfer bushing is configured to engage the floor mounted support structure such that downward axial movement of the elevator relative to the floor mounted support structure displaces the load transfer bushing with respect to the elevator while the elevator is in the closed position, and, when the load transfer bushing engages the floor mounted support structure and has been displaced with respect to the elevator, the elevator is movable to the open position without separating the first and second arcuate segments of the load transfer bushing apart, and wherein the elevator comprises a locking mechanism configured to prevent axial displacement of the load transfer bushing from within the elevator, wherein the locking mechanism is configured such that the load transfer bushing engaging the floor mounted support structure causes the locking mechanism to disengage from the load transfer bushing.

2. The load transfer system of claim 1, wherein the floor mounted support structure comprises a spear.

3. The load transfer system of claim 2, wherein the spear is configured to support a weight of the tubular via engagement with the load transfer bushing.

4. The load transfer system of claim 2, wherein a bottom surface of the load transfer bushing defines an annular groove configured to receive a top surface of the spear.

5. The load transfer system of claim 2, wherein the elevator is configured to be laterally moved onto or from around the tubular when in the open position.

6. The load transfer system of claim 2, wherein the locking mechanism comprises at least one radially-movable locking plate having a top surface that engages the load transfer bushing, and a lower surface that engages the spear, and wherein the lower surface engaging the spear causes the locking mechanism to disengage from the load transfer bushing.

7. The load transfer system of claim 6, wherein the load transfer bushing defines an angled locking plate-engaging surface and a locking plate-receiving slot, wherein the locking plate engaging surface slides axially downward relative to the top surface of the radially-movable locking plate, pushing the radially-movable locking plate radially outwards with respect to the elevator as the load transfer bushing is received axially into the elevator, and wherein the locking plate-receiving slot receives the top surface of the locking plate therein when the load transfer bushing is received into the elevator.

8. The load transfer system of claim 7, wherein the lower surface of the radially-movable locking plate engaging the spear causes the radially-movable locking plate to move radially outward with respect to the elevator, such that the top surface moves out of the locking plate-receiving slot.

9. The load transfer system of claim 1, wherein:

the elevator comprises a locking mechanism configured to prevent axial displacement of the load transfer bushing from within the elevator, wherein the locking mechanism comprises:

at least one radially-movable locking plate having a top surface that engages the load transfer bushing; and at least one retainer pin, the load transfer bushing defines an angled locking plate-engaging surface and a locking plate-receiving slot, wherein the locking plate-engaging surface slides axially downward relative to the top surface of the radially-movable locking plate, pushing the radially-movable locking plate radially outwards with respect to the elevator as the load transfer bushing is received axially into the elevator, wherein the locking plate-receiving slot receives the top surface of the locking plate therein when the load transfer bushing is received into the elevator, and the at least one retainer pin is received into a pocket formed in the radially-movable locking plate, wherein the at least one retainer pin is manually displaceable to allow disengagement of the load transfer bushing from the elevator.

10. The load transfer system of claim 1, wherein the elevator comprises a plurality of retainers, and wherein each of first and second arcuate segments include a slot configured to receive one of the plurality of retainers to prevent circumferential movement of the arcuate segments relative to the elevator.

11. The load transfer system of claim 1, further comprising a spear, wherein the first and second arcuate segments are free from connections with one another, and wherein the load transfer bushing is disengageable from the elevator while the elevator is in the closed position by engagement between the load transfer bushing and the spear.

12. The load transfer system of claim 1, wherein the locking mechanism comprises a latch plate retainer pin that is received axially through the elevator, wherein the locking mechanism is further configured to disengage from the load transfer bushing by manually moving the latch plate retainer pin upwards with respect to the elevator.

13. A method for running tubulars, comprising:

receiving a load transfer bushing into an elevator, wherein receiving the load transfer bushing into the elevator causes a locking mechanism of the elevator to engage the load transfer bushing;

opening the elevator, wherein opening the elevator causes two segments of the load transfer bushing to separate apart;

receiving the elevator and the load transfer bushing around a tubular while the elevator is open;

closing the elevator, wherein closing the elevator causes the two segments of the load transfer bushing to at least partially surround and form an axial engagement load surface for the tubular or a collar secured to the tubular;

raising the tubular by lifting the elevator, wherein the elevator supports a weight of the tubular by engagement with the load transfer bushing;

lowering the tubular through a spear by lowering the elevator, until the load transfer bushing engages the spear;

continuing to lower the elevator with respect to the spear after engaging the load transfer bushing with the spear, such that the spear disengages the load transfer bushing from the elevator, wherein the spear supports the weight of the tubular through engagement with the load transfer bushing after disengaging the load transfer bushing from the elevator, and wherein the load transfer bushing engaging the spear causes the locking mechanism to disengage from the load transfer bushing;

again opening the elevator after the spear disengages the load transfer bushing from the elevator, wherein the load transfer bushing remains engaged with the tubular when the elevator is again opened; and removing the elevator from around the spear, the tubular, and the load transfer bushing.

14. The method of claim 13, wherein receiving the load transfer bushing into the elevator comprises:

pushing a top engaging feature of a plate of the locking mechanism radially outwards; and receiving the top engaging feature of the plate into a plate-receiving slot of the load transfer bushing.

15. The method of claim 14, wherein lowering elevator until the load transfer bushing engages the spear comprises pushing a lower engaging feature of the plate radially outwards with respect to the elevator by engagement with the spear, and wherein the top engaging feature of the plate moves out of the plate-receiving slot.

16. The method of claim 13, further comprising:

connecting a second tubular to the tubular received through the spear, such that the weight of the tubular received through spear is supported by a connection to the second tubular; and opening the spear after removing the elevator, wherein opening the spear separates the segments of the load transfer bushing apart.

17. The method of claim 13, wherein receiving the load transfer bushing into the elevator comprises receiving slots in the load transfer bushing into upwardly-extending retainers formed in the elevator.

18. The method of claim 13, wherein receiving the load transfer bushing into the elevator is performed near a rig floor, and receiving the elevator and the load transfer bushing around the tubular is performed near a top of the tubular.

19. A load transfer system, comprising:

a spear coupled to a rig floor and positioned over a well center;

an elevator suspended from the rig and configured to be raised and lowered with respect to the spear; and a load transfer bushing configured to axially engage a load surface of a tubular or of a collar coupled to the tubular, wherein the load transfer bushing is receivable into the elevator such that opening the elevator causes the load transfer bushing to open, so as to receive the load transfer bushing and the elevator around the tubular, wherein the load transfer bushing is disengageable from the elevator, and wherein the load transfer bushing is configured to remain engaged with the spear and the tubular after the elevator is disengaged from the load transfer bushing, such that a weight of the tubular is transferred to the spear via the load transfer bushing.

20. The load transfer system of claim 19, wherein the load transfer bushing is disengageable from the elevator by the spear engaging the load transfer bushing and the elevator being lowered with respect to the spear.

21. The load transfer system of claim 19, wherein the load transfer bushing comprises a first arcuate segment and a second arcuate segment, wherein when the load transfer bushing engages the elevator and the load transfer bushing is removeable from within the elevator while the elevator is in a closed position.

22. The load transfer system of claim 19, wherein:

the elevator comprises a locking mechanism movable between a first position and a second position, in the first position, the locking mechanism prevents axial displacement of the load transfer bushing relative to the elevator, in the second position, the locking mechanism permits axial displacement of the load transfer bushing relative to the elevator, and the locking mechanism engaging the spear causes the locking mechanism to move from the first position to the second position.

23. The load transfer system of claim 19, wherein the load transfer system is configured to be disengaged from within the elevator, while the elevator is closed around the tubular, by the elevator being lowered with respect to the spear.

* * * * *